US008523325B2

(12) United States Patent
Sakurai et al.

(10) Patent No.: US 8,523,325 B2
(45) Date of Patent: Sep. 3, 2013

(54) LIQUID EJECTION HEAD AND INK JET PRINTING APPARATUS

(75) Inventors: Masataka Sakurai, Kawasaki (JP); Ken Tsuchii, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 27 days.

(21) Appl. No.: 13/147,213

(22) PCT Filed: Feb. 5, 2010

(86) PCT No.: PCT/JP2010/000717

§ 371 (c)(1),
(2), (4) Date: Aug. 1, 2011

(87) PCT Pub. No.: WO2010/090042

PCT Pub. Date: Aug. 12, 2010

(65) Prior Publication Data

US 2012/0056940 A1 Mar. 8, 2012

(30) Foreign Application Priority Data

Feb. 6, 2009 (JP) ..... 2009-026476

(51) Int. Cl.
*B41J 2/14* (2006.01)
*B41J 2/04* (2006.01)
*B41J 2/05* (2006.01)

(52) U.S. Cl.
USPC ..... 347/50; 347/54; 347/65

(58) Field of Classification Search
None
See application file for complete search history.

(56) References Cited

U.S. PATENT DOCUMENTS

| | | | | |
|---|---|---|---|---|
| 5,208,605 | A * | 5/1993 | Drake | 347/15 |
| 5,619,236 | A | 4/1997 | Keefe et al. | |
| 6,830,317 | B2 | 12/2004 | Tsuchii et al. | |
| 7,380,905 | B1 | 6/2008 | Silverbrook | |
| 7,533,960 | B2 | 5/2009 | Yasuda et al. | |
| 7,591,531 | B2 | 9/2009 | Tsuchii et al. | |
| 7,654,643 | B2 | 2/2010 | Silverbrook | |

(Continued)

FOREIGN PATENT DOCUMENTS

| | | |
|---|---|---|
| CN | 1654215 A | 8/2005 |
| CN | 1982066 A | 6/2007 |

(Continued)

OTHER PUBLICATIONS

Office Action dated Sep. 4, 2012, in Japanese Application No. 2009-026476.

(Continued)

*Primary Examiner* — Geoffrey Mruk
(74) *Attorney, Agent, or Firm* — Fitzpatrick, Cella, Harper & Scinto

(57) ABSTRACT

A power supply-heater wiring and a heater-driving circuit wiring for a heater located on the right side of a supply port can be laid out utilizing a beam portion configured to separate supply ports from each other. Furthermore, a plurality of supply ports are provided to supply ink to channels and pressure chambers and separated from one another by beam portions. Thus, an ejection structure such as an ejection opening can be located on both sides of each of the supply ports. Even if the ejection structures are relatively densely arranged, the heaters and the like can have necessary and sufficient sizes and locations without being restricted by the arrangement. A wiring connecting the heater to the power supply wiring or driving circuit is also laid out on the beam portion serving as a partition wall for the supply ports.

19 Claims, 17 Drawing Sheets

(56) References Cited

U.S. PATENT DOCUMENTS

| | | | |
|---|---|---|---|
| 7,784,904 | B2 | 8/2010 | Ide et al. |
| 7,926,917 | B2 | 4/2011 | Tsuchii et al. |
| 7,984,968 | B2 | 7/2011 | Silverbrook |
| 2004/0179073 | A1 | 9/2004 | Valley et al. |
| 2008/0174639 | A1 | 7/2008 | Park et al. |
| 2009/0231394 | A1 | 9/2009 | Inoue et al. |
| 2010/0201748 | A1 | 8/2010 | Kishikawa et al. |

FOREIGN PATENT DOCUMENTS

| | | | |
|---|---|---|---|
| CN | 101269575 | A | 9/2008 |
| JP | 9-76498 | A | 3/1997 |
| JP | 9-123456 | A | 5/1997 |
| JP | 10-138478 | A | 5/1998 |
| JP | 10-166584 | A | 6/1998 |
| JP | 2001-179963 | A | 7/2001 |
| JP | 2001-246745 | A | 9/2001 |
| JP | 2006-123521 | A | 5/2006 |
| JP | 2006-159893 | A | 6/2006 |
| JP | 2007-38567 | A | 2/2007 |
| JP | 2007-283632 | A | 11/2007 |
| JP | 2008-149666 | A | 7/2008 |

OTHER PUBLICATIONS

Notice of Reasons for Refusal mailed May 22, 2012, in Japanese Application No. 2009-026476.

Official Action mailed Oct. 26, 2012, in Russian Application No. 2011133048/12(048767).

International Preliminary Report on Patentability, International Application No. PCT/JP2010/000717, filed on Feb. 5, 2010.

Office Action dated Jun. 21, 2013, in Chinese Application No. 201080006638.6.

* cited by examiner

FIG.3A
PRIOR ART
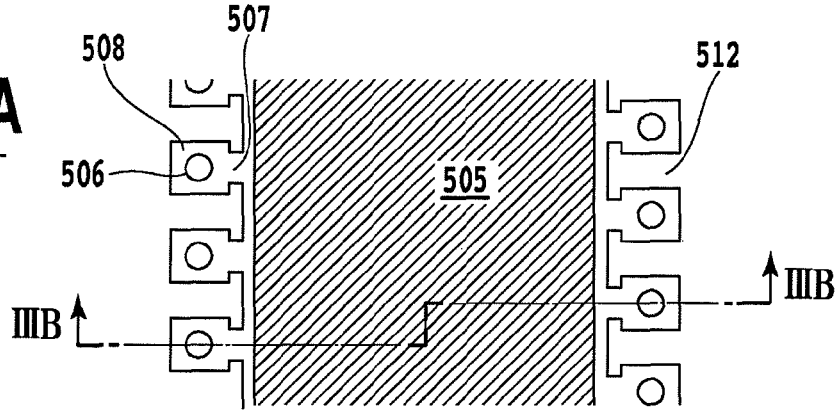
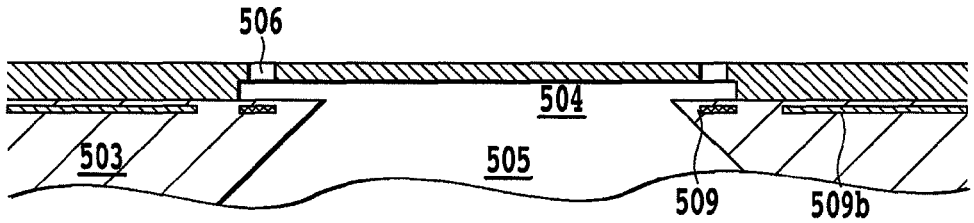
FIG.3B
PRIOR ART
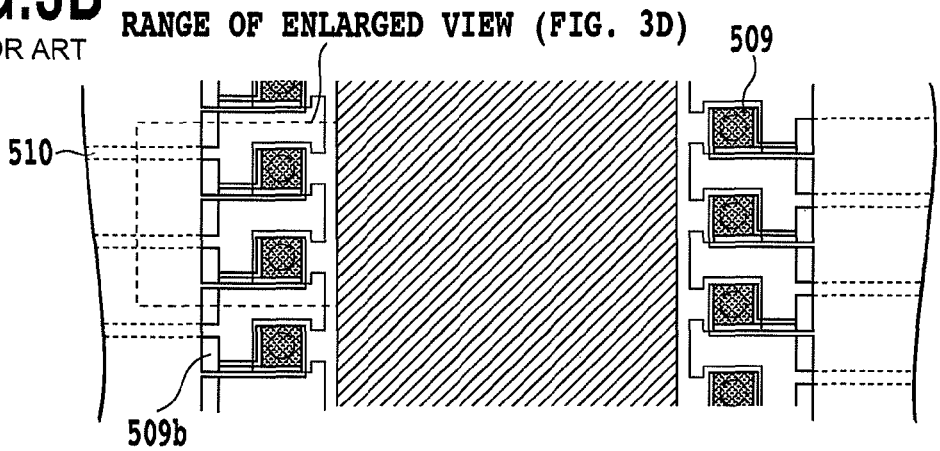
FIG.3C
PRIOR ART
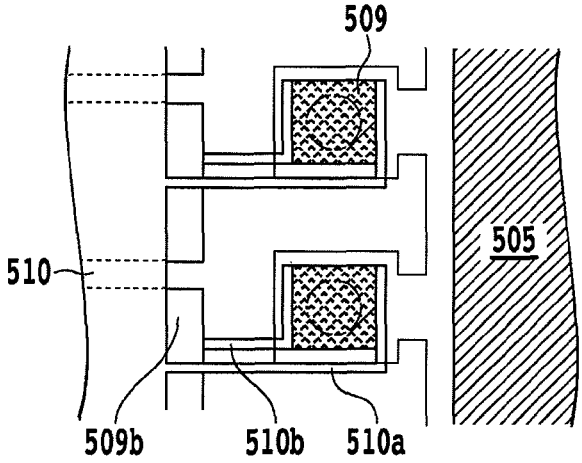
FIG.3D
PRIOR ART FIG.16A
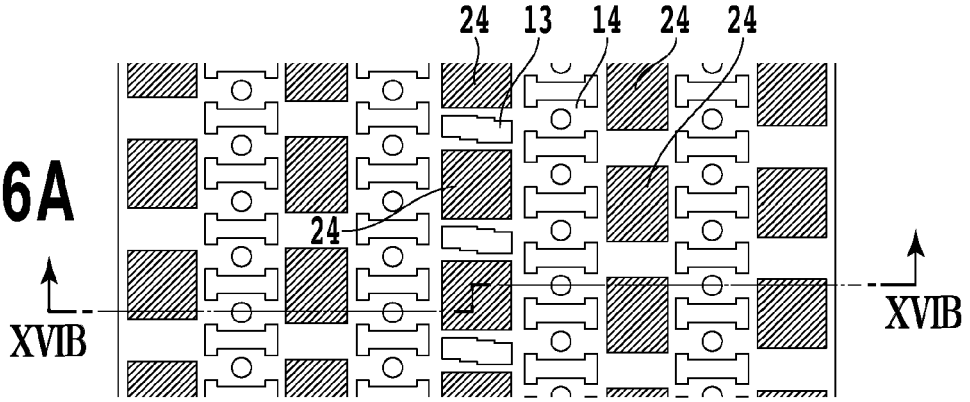
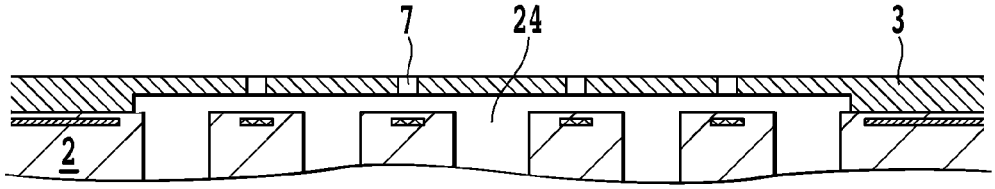
FIG.16B
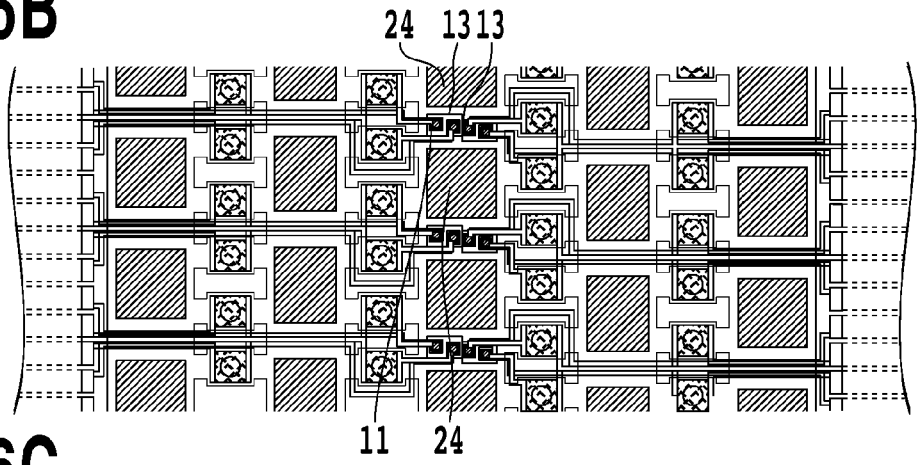
FIG.16C
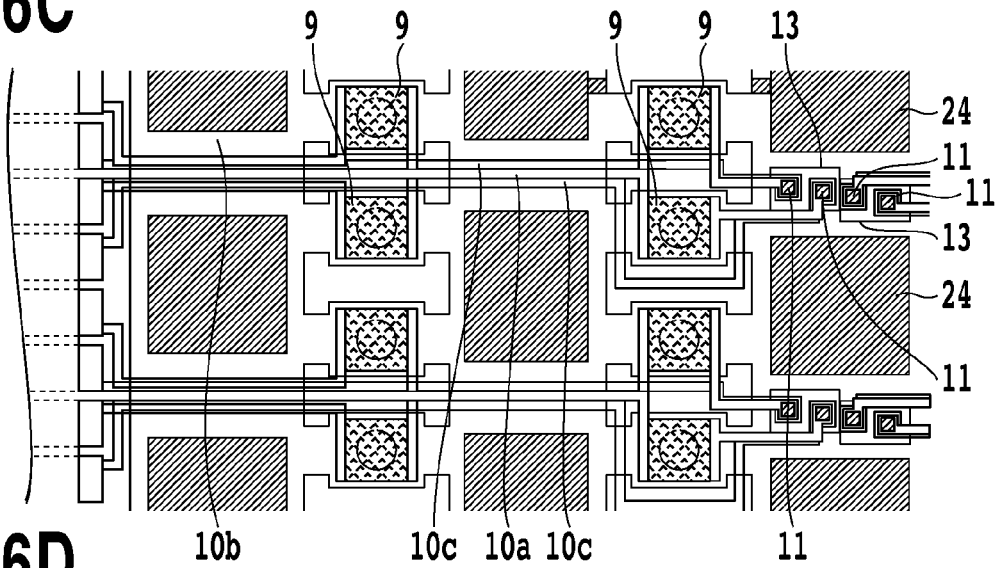
FIG.16D

LIQUID EJECTION HEAD AND INK JET PRINTING APPARATUS

TECHNICAL FIELD

The present invention relates to a liquid ejection head such as a print head for ejecting ink, and an ink jet printing apparatus, and specifically, to the configuration of channels through which a liquid is supplied to individual chambers in which ejection energy generating elements are arranged as well as wirings used to drive the elements.

BACKGROUND ART

In a known print head, heaters serving as energy generating elements are arranged on a substrate in two arrays. One supply port is formed between the heater arrays so as to penetrate the substrate. Thus, ink is supplied, through the supply port, to pressure chambers in which the respective heaters are arranged.

FIG. 1A is a partly sectional perspective view showing a main part of such a conventional print head. FIG. 1B is a view which is similar to FIG. 1A but from which an orifice plate 502 shown in FIG. 1A is omitted. As shown in FIG. 1A, a substrate 503 is provided with a plurality of heaters 509, driving circuits 509*b* for driving the heaters 509, and logic circuits 509*c* configured to determine whether to allow the driving circuits to turn on or off ejection. Furthermore, the orifice plate 502 is laid on top of the substrate 503 to form ejection openings 506, pressure chambers 508 (FIG. 1B), and channels 507 (FIG. 1B), which correspond to the individual heaters 509. In this manner, the two arrays of the heaters (the arrays of the pressure chambers and channels) are provided on the substrate, and the ink supply port 505 is formed as a hole located between the heater arrays and extending along the heater arrays and through the substrate. Thus, ink fed from an ink tank via the supply port 505 is supplied to the individual channels 507 and pressure chambers 508, arranged on the both sides of the supply port, in conjunction with an ink ejecting operation.

FIG. 2 is a plan view showing a substrate on which six units of arrays of heaters (and ejection openings) are provided; one unit of arrays of heaters is shown in FIGS. 1A and 1B. The one unit of arrays corresponds to one type of ink. Thus, FIG. 2 shows the basic configuration of the print head configured to eject six types of ink, for example, cyan, magenta, yellow, light cyan and magenta having lower color material concentrations, and black. As shown in FIG. 2, two power supply electrodes 510 are provided so as to sandwich the supply port 505 between the electrodes 510, with the heater arrays arranged on the both sides of the supply port 505. That is, each of the two power supply electrodes 510, which is configured to receive external power via electrodes 511, supplies power to drive the heater array on the same side as that of the power supply electrode with respect to the supply port 505. Furthermore, the driving circuit 509*b* drives the heater array on the same side as that of the driving circuit 509*b* with respect to the supply port 505.

FIG. 3A is a plan view showing an example of the configuration of the above-described print head, particularly of the ejection openings (heaters), pressure chambers, and channels. FIG. 3B is a sectional view taken along line IIIB-IIIB in FIG. 3A. Moreover, FIG. 3C is a plan view of the configuration shown in FIG. 3A and to which driving circuits, power supply wirings, and heaters are added. FIG. 3D is an enlarged view of an area in FIG. 3C which is shown by a dashed line. In the print head configured as shown in these figures, a part of the space formed between the substrate 503 and the orifice plate 502 functions as a common liquid chamber 504. The liquid supply port 505 communicates with the common liquid chamber 504. Furthermore, the individual channels 507 extend in communication with the common liquid chamber 504. The pressure chamber 508 is formed at an end of each of the channels 507 which is opposite to the common liquid chamber 504. Each of the ejection openings 506 are formed in the orifice plate 502 so as to communicate with the corresponding pressure chamber 508. The heater 509 is located at a position in the pressure chamber which corresponds to the ejection opening 506. Ink supplied to the common liquid chamber 504 via the liquid supply port 505 is fed to the pressure chambers 508 via the respective channels 507. In each of the pressure chambers 508, the heater 509 supplies thermal energy to the ink. Based on the supply of the thermal energy, the ink is ejected through the ejection opening 506.

As shown in FIGS. 3C and 3D, for each of the heater arrays on the both sides of the supply port 505, a power supply-heater wiring 510*a* connecting the power supply wiring 510 and the heater 509 together and a heater-driving circuit wiring 510*b* connecting the heater 509 and the driving circuit 509*b* together are provided for each heater.

FIGS. 4A to 4D are views showing another conventional example of a print head described in PTL1. This print head is different from that shown in FIGS. 3A to 3D in that the former has an increased ejection opening arrangement density. More specifically, the ejection openings (and corresponding heaters, pressure chambers, and the like) are staggered and thus densely arranged. This has the advantage of being able to inhibit an increase in the size of the print head, particularly of the substrate, thus reducing the manufacture costs of the print head.

As shown in FIGS. 4A to 4D, on the substrate 503, two arrays each comprising a plurality of units each including the heater 509, the pressure chamber 508, and the channel 507 are provided on the respective both sides of the supply port 505. The units in each of the two arrays are alternately arranged at a long distance and a short distance from the supply port 505. Thus, compared to the configuration in which the same number of the units are simply arranged in a line along the longitudinal direction of the supply port 505, the configuration shown in FIGS. 4A to 4D allows an increase in arrangement density. This enables an increase in the number of units disposed on a substrate of the same size. In this case, the scales of the driving circuit 509 and the logic circuit (not shown in the drawings) need to be increased by amounts corresponding to the increased number of ejection openings. However, the area occupied by the circuits can be reduced compared to that in the case where two arrays are provided each of which comprises the supply port, heaters, driving circuits, and logic circuits (not shown in the drawings) as shown in FIG. 3. That is, the arrangement area required for two supply ports in the individual arrangement of the units can be reduced to almost half, thus enabling a reduction in substrate area. Furthermore, compared to the arrangement in which the units are simply arranged along the longitudinal direction of the supply port 505, the staggered arrangement of the units including the ejection openings provides a sufficient thickness for each partition wall 512 configured to partition the channels. This prevents the reliability of the print head from being degraded.

In the above-described configuration of the ejection openings (heaters), pressure chambers, and channels, each of the power supply-heater wiring 510*a* and the heater-driving circuit wiring 510*b* has two types of layout lengths.

CITATION LIST

Patent Literature

[PTL 1] Japanese Patent Laid-Open No. 2006-159893

SUMMARY OF THE INVENTION

Technical Problem

As described above, the staggered arrangement of the ejection openings allows an increase in the arrangement density of the units including the ejection openings. However, in a case of the staggered arrangement, in the array of ejection openings 506*a* nearer to the supply port 505, a channel 507*b* for a pressure chamber 508*b* which is far from the supply port 505 is located between a pressure chamber 508*a* for the ejection opening 506*a* and the adjacent pressure chamber 508*a* for the adjacent ejection opening 506*a*. Thus, the volume and area for the nearer pressure chamber 508*a* and ejection opening 506*a* are restricted, resulting in limited characteristics such as a designable ejection amount. For example, as shown in FIGS. 4C and 4D, heaters and pressure chambers in which the respective heaters are arranged may have smaller areas than those which are far from the supply port.

In contrast, the channel 507*b* for the farther pressure chamber 508*b* is formed between the nearer pressure chambers 508*a*. Thus, providing the channel 507*b* with a large width is difficult. Furthermore, the length of the channel 507*b* needs to be increased depending on the size of the pressure chamber 508*b*. The restrictions on the width and length of the channel tend to increase the time required to refill ink after ejection through the farther ejection opening 506*b*. Thus, reducing ejection cycle (increasing ejection frequency) becomes difficult.

The above-described various restrictions are partly caused by the arrangement in which for the same type of ink, the ejection openings (and the associated heaters and the like) are divided into two groups by the one supply port 505. More specifically, the supply port 505 is used to supply ink to the plurality of ejection openings arranged on the both sides of the supply port 505. The supply port 505 thus extends relatively long along the array of the ejection openings, and has a relatively large area in order to allow the supply of a large amount of ink for the plurality of ejection openings. As a result, in particular, an increase in the arrangement density of the ejection openings limits the installation location or area of the heaters, the pressure chambers, and the channels. This results in the above-described various restrictions. In this case, besides the above-described pressure chambers and channels, the arrangement of the wirings constructed on the substrate may similarly be restricted.

An object of the present invention is to provide a liquid ejection head in which pressure chambers, channels, and the like can be densely arranged on a substrate without suffering the above-described restrictions, thus enabling the refill frequency to be improved, as well as a related ink jet printing apparatus.

Solution to Problem

In a first aspect of the present invention, there is provided a liquid ejection head for ejecting liquid, comprising: a plurality of supply ports through which the same kind of liquid is supplied to pressure chambers each of which communicates with an ejection opening and in each of which an ejection energy generating element is provided; a beam portion configured to separate the plurality of supply ports from each other; and a wiring provided in the beam portion, the wiring being used for driving the ejection energy generating element.

In a second aspect of the present invention, there is provided a liquid ejection head comprising: a plurality of pressure chambers provided correspondingly to a plurality of ejection openings for ejecting liquid, the plurality of pressure chambers including energy generating elements for generating energy used for ejecting the liquid; and a substrate provided with a supply port array in which a plurality of supply ports each of which is formed as a hole passing through the substrate and is configured to supply the liquid to the pressure chamber are arrayed and a energy generating element array which is apposed to the supply port array and in which a plurality of the energy generating elements are arrayed, wherein wirings used for driving the energy generating elements are formed in beam portions each of which is formed between the plurality of supply ports in the supply port array.

In a third aspect of the present invention, there is provided an ink jet printing apparatus that performs printing by using a print head for ejecting ink, wherein the print head comprises: a plurality of supply ports through which the same kind of ink is supplied to pressure chambers each of which communicates with an ejection opening and in each of which an ejection energy generating element is provided; a beam portion configured to separate the plurality of supply ports from each other; and a wiring provided in the beam portion, the wiring being used for driving the ejection energy generating element.

Advantageous Effects of the Invention

According to the above-described configuration, in the liquid ejection head, the pressure chambers, channels, and the like can be densely arranged on the substrate as well as the refill frequency being improved. Moreover, for example, the wirings used to drive the ejection energy generating elements can be laid out on the beam portions serving as partition walls for the supply port. This enables wiring to be achieved by efficiently utilizing the arrangement of the plurality of supply ports.

BRIEF DESCRIPTION OF DRAWINGS

FIG. 3A is a plan view showing an example of the configuration of the conventional print head, particularly of ejection openings (heaters), pressure chambers, and channels, FIG. 3B is a sectional view taken along line IIIB-IIIB in FIG. 3A;

FIG. 3C is a plan view of the configuration shown in FIG. 3A and to which driving circuits, power supply wirings, and heaters are added;

FIG. 3D is an enlarged view of an area in FIG. 3C which is shown by a dashed line;

FIG. 16A is a view illustrating an eighth embodiment of the present invention and is similar to FIG. 14A illustrating the sixth embodiment;

FIG. 16B is a view illustrating the eighth embodiment of the present invention and is similar to FIG. 14B illustrating the sixth embodiment;

FIG. 16C is a view illustrating the eighth embodiment of the present invention and is similar to FIG. 14C illustrating the sixth embodiment;

FIG. 16D is a view illustrating the eighth embodiment of the present invention and is similar to FIG. 14D illustrating the sixth embodiment.

DESCRIPTION OF EMBODIMENTS

Embodiments of the present invention will be described below in detail with reference to the drawings.

Figure 5:
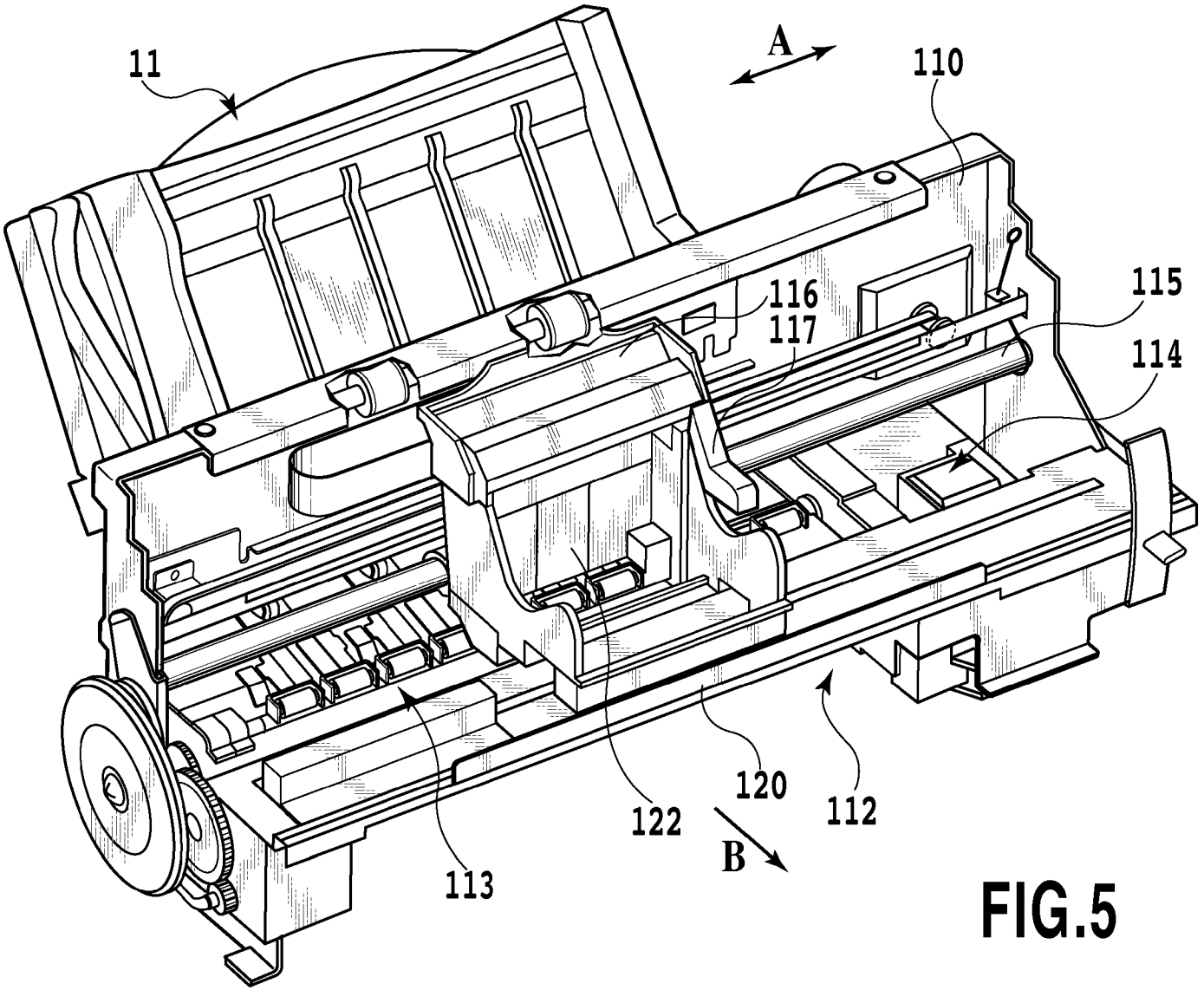
FIG. 5 is a perspective view showing an ink jet printing apparatus that uses an ink jet print head according to an embodiment of the present invention.
Figure 6:
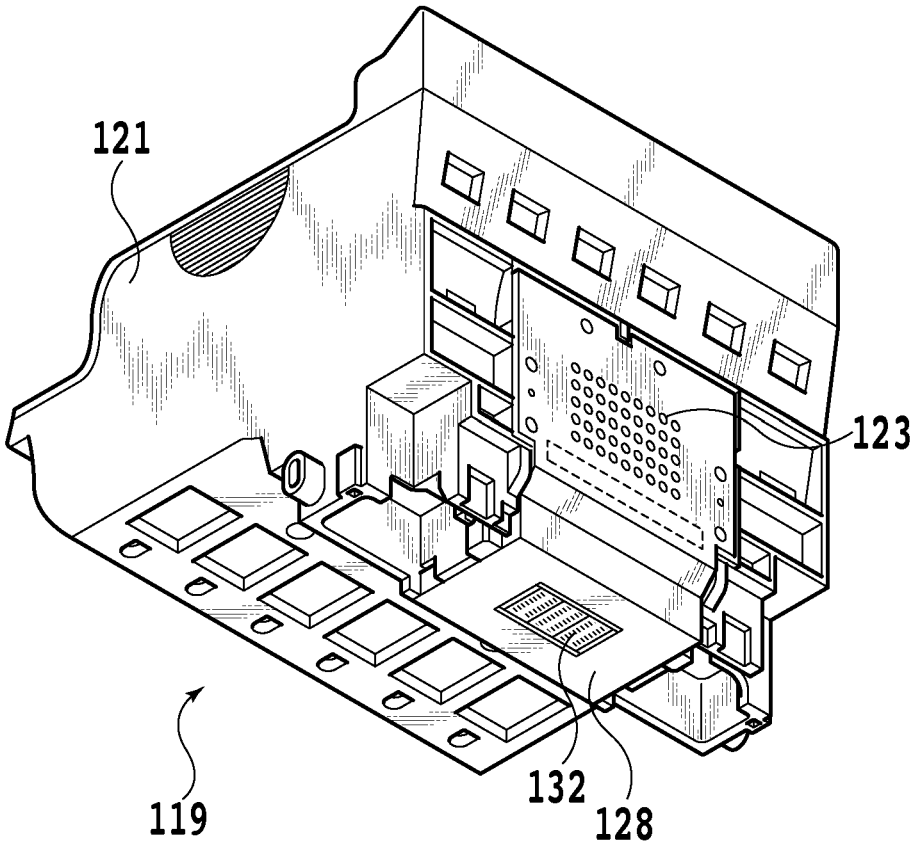
FIG. 6 is a view showing the appearance of a head cartridge including the print head used in the ink jet printing apparatus according to the embodiment.
Figure 7:
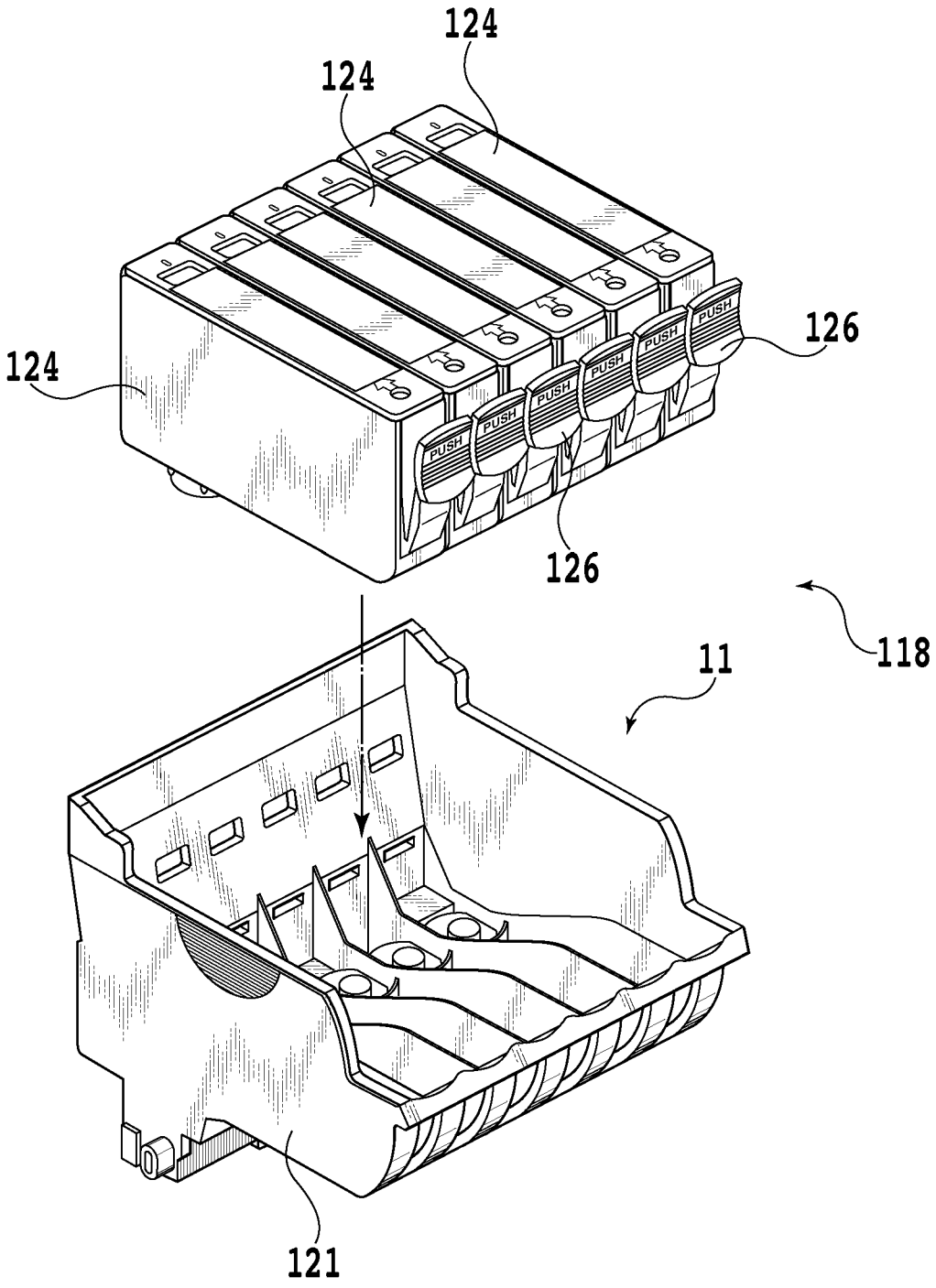
FIG. 7 is a view showing the appearance of the print head.

FIG. 5 is a perspective view showing an ink jet printing apparatus that uses an ink jet print head according to an embodiment of the present invention. FIG. 6 is a view showing the appearance of a head cartridge including the print head used in the ink jet printing apparatus. Moreover, FIG. 7 is a view showing the appearance of the print head. A chassis 110 of the ink jet printing apparatus according to the present embodiment comprises a plurality of plate-like metal members with a predetermined rigidity. The chassis 110 forms the framework of the ink jet printing apparatus. The chassis 110 includes a medium feeding section 111 configured to feed a sheet-like print medium (not shown in the drawings) to a print section, and a medium conveying section 113 configured to guide the print medium fed from the medium feeding section 111 to a desired print position and from the print position to a medium discharge section 112. The chassis 111 further includes a print section configured to perform a predetermined printing operation on the print medium conveyed at a print position, and a head recovery section 114 configured to execute a recovery process on the print section.

The print section includes a carriage 116 supported so as to be movable along a carriage shaft 115 for scanning, and a head cartridge 118 mounted in the carriage 116 so as to be removable by operation of a head set lever 117.

The carriage 116, in which the head cartridge 118 is mounted, includes a carriage cover 120 configured to allow the print head 119 in the head cartridge 118 to be placed at a predetermined installation position on the carriage 116. Moreover, the carriage 116 includes the head set lever 117 configured to engage with a tank holder 121 of the print head 119 to press and place the print head 119 at the predetermined installation position.

One end of a contact flexible print cable (hereinafter also referred to as a contact FPC) 122 is coupled to another portion of the carriage 116 configured to engage with the print head 119. A contact portion (not shown in the drawings) formed at this end of the contact FPC 122 electrically contacts a contact portion 123 provided in the print head 119. This allows the transmission of various pieces of information for printing, the supply of power to the print head 119, and the like.

The head cartridge 118 according to the resent embodiment includes an ink tank 124 in which ink is stored, and the print head 119 configured to eject ink fed from the ink tank 124, through ejection openings in accordance with print data. The print head 119 comprises an array of heaters corresponding to the ejection openings and wirings for the heaters; the heaters and the wirings are provided on the substrate. The print head 119 is of what is called a cartridge type in which the print head 119 is removably mounted in the carriage 116.

Furthermore, the present embodiment allows six independent ink tanks 124 for black (Bk), light cyan (c), light magenta (m), cyan (C), magenta (M), and yellow (Y) to be used for the apparatus in order to enable photographic high-quality color printing. Each of the ink tanks 124 includes an elastically deformable removal lever 126 that can be locked on the head cartridge 118. Operation of the removal lever 125 enables the ink tank 124 to be removed from the print head 119 as shown in FIG. 7.

Embodiment 1

A print head according to a first embodiment of the present invention relates to a configuration in which a plurality of ink supply ports are provided for each of the Bk, c, m, C, M, and Y inks. Two heaters and two pressure chambers are provided in association with each of the supply ports.

Figure 1A:
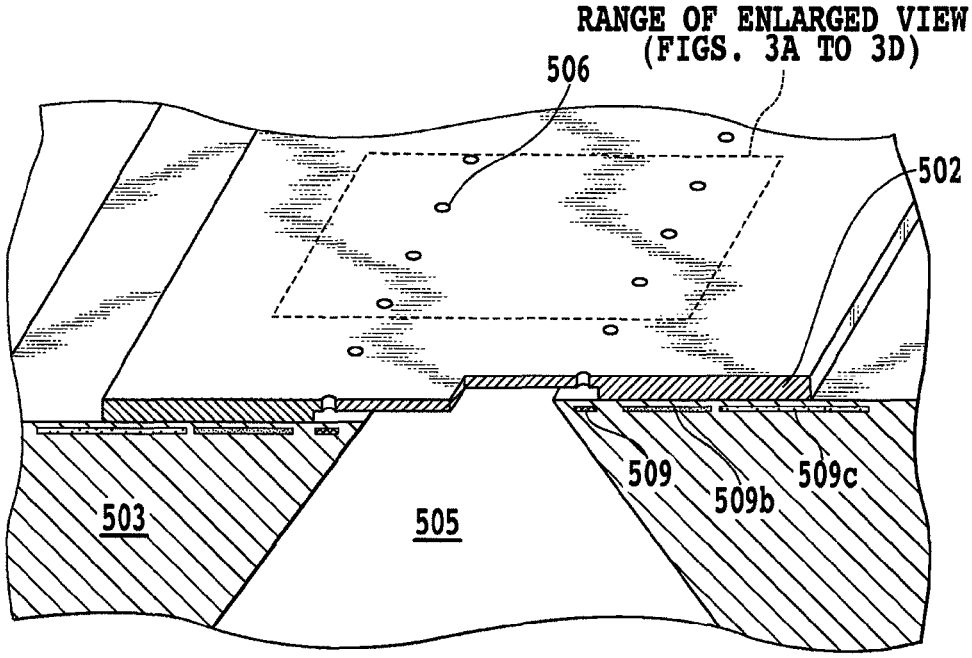
FIG.1A PRIOR ART
FIG. 1A is a partly sectional perspective view showing an integral part of a conventional print head.
Figure 1B:
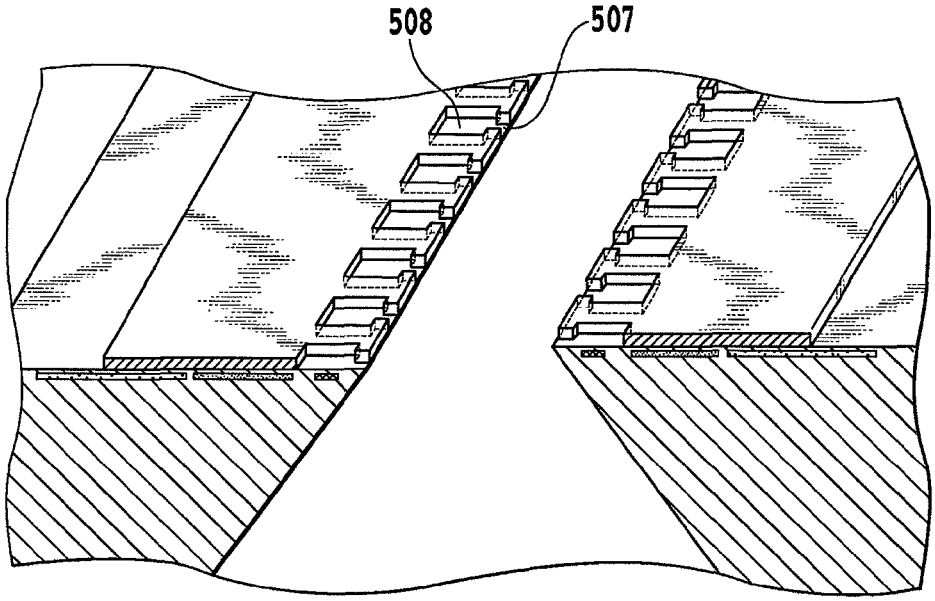
FIG.1B PRIOR ART
FIG. 1B is a diagram which is similar to FIG. 1A and from which an orifice plate 502 shown in FIG. 1A is omitted.
Figure 2:
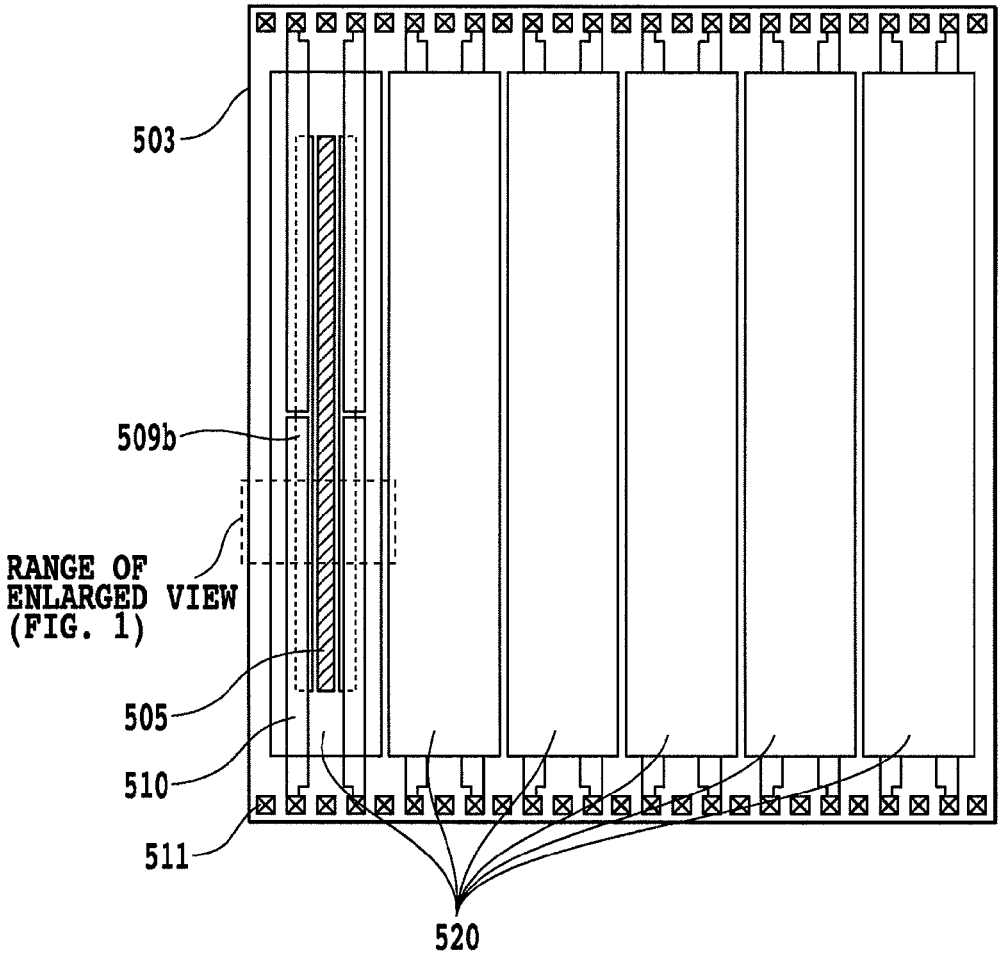
FIG.2 PRIOR ART
FIG. 2 is a plan view showing a substrate on which six units each including arrays of heaters (and ejection openings) shown in FIGS. 1A and 1B are provided.
Figure 8A:
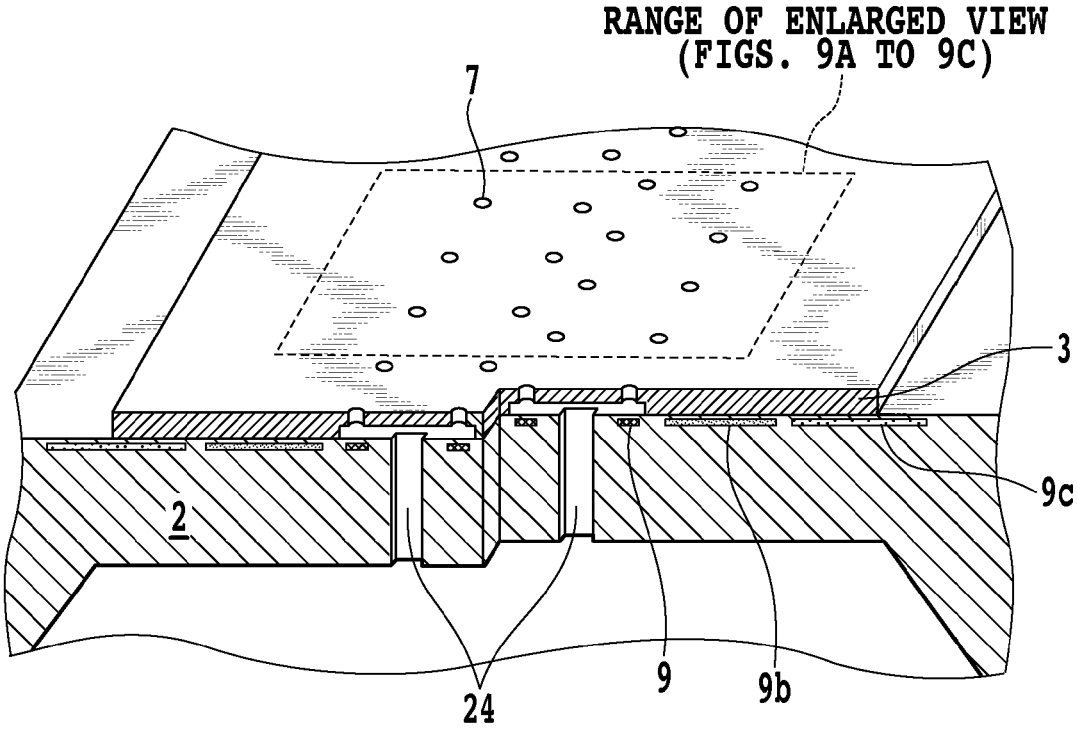
FIG. 8A is a perspective view showing an orifice plate and a substrate included in a print head according to a first embodiment of the present invention wherein ejection openings are formed in the orifice plate and driving circuits 9 configured to drive heaters and logic circuits 9*c* configured to select the respective driving circuits are formed on the substrate.
Figure 8B:
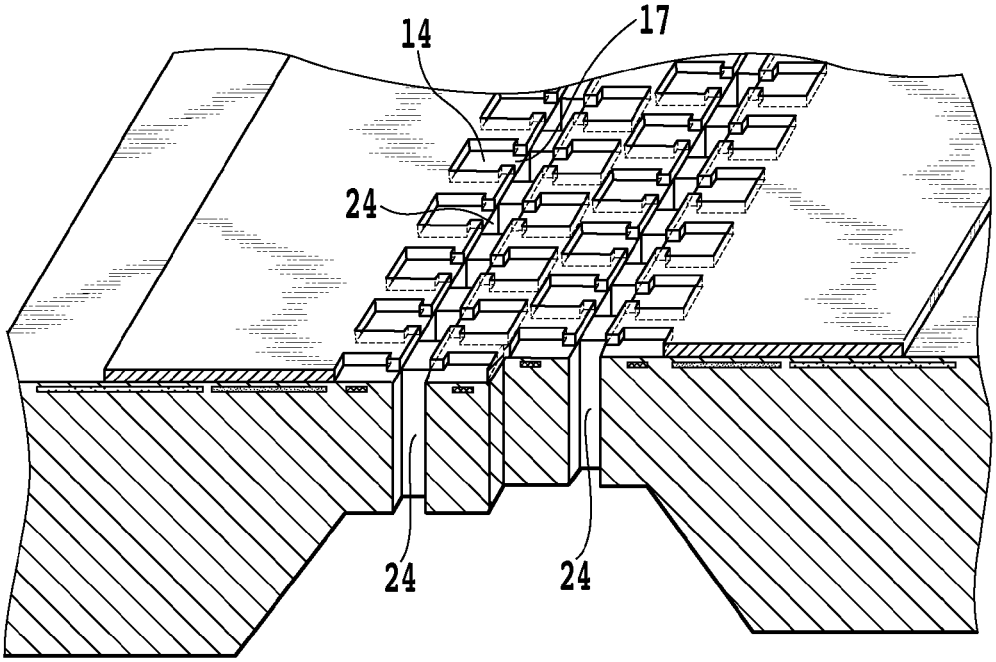
FIG. 8B is a perspective view showing the interior of the print head in which the upper part of the orifice plate shown in FIG. 8A is omitted.

FIG. 8A is a perspective view showing a substrate 2 on which an orifice plate 3 in which ejection openings 7 are formed, driving circuits 9*b* for driving heaters 9, and logic circuits 9*c* for selecting the respective driving circuits are formed, which elements form the print head according to the present embodiment. The configuration shown in FIG. 8A is provided for each of the Bk, c, m, C, M, and Y inks. That is, as shown in FIG. 2, the configuration relates to one of six units of arrays of heaters (and ejection openings) which units correspond to the respective colors of the ink. FIG. 8B is a perspective view showing the interior of the print head with the upper portion of the orifice plate 3 shown in FIG. 8A being omitted. FIG. 8B shows a structure configured to introduce ink from a supply port 24 into a pressure chamber 14 via a channel 17. As shown in the figures, the substrate 2 and the orifice plate 3 are joined together to form channels 7 and pressure chambers 14, which communicate with the respective ink supply ports 24, in a part of the space between the substrate 2 and the orifice plate 3.

Figure 9A:
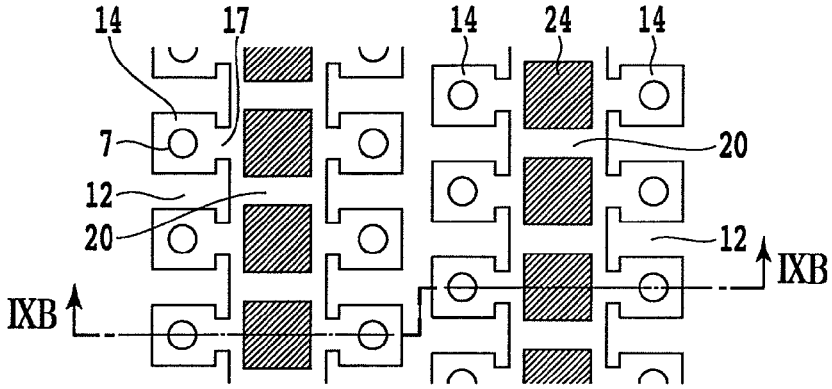
FIG. 9A is a plan view showing the arrangement of ejection openings, pressure chambers, channels, and ink supply ports in the print head shown in FIG. 8.
Figure 9B:
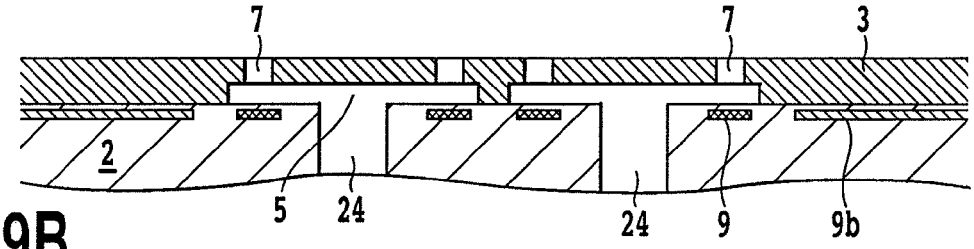
FIG. 9B is a sectional view taken along line IXB-IXB in FIG. 9A.
Figure 9C:
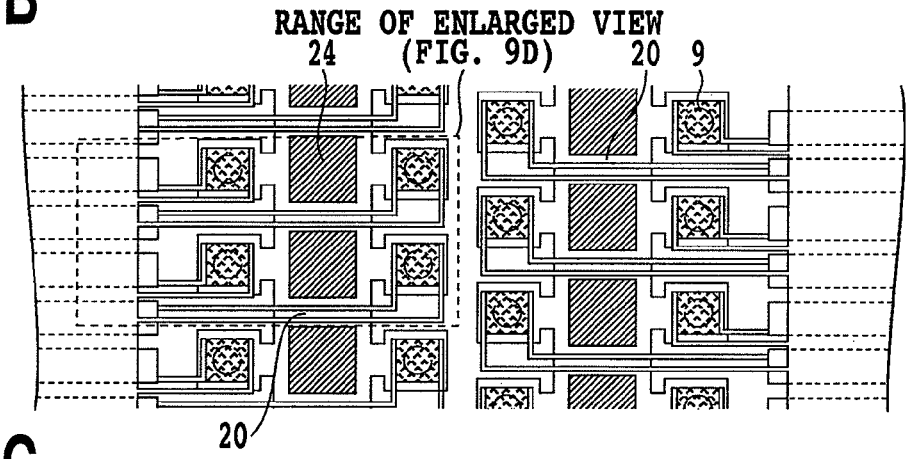
FIG. 9C is a plan view of the arrangement shown in FIG. 9A and to which driving circuits, power supply wirings, and heaters are added.
Figure 9D:
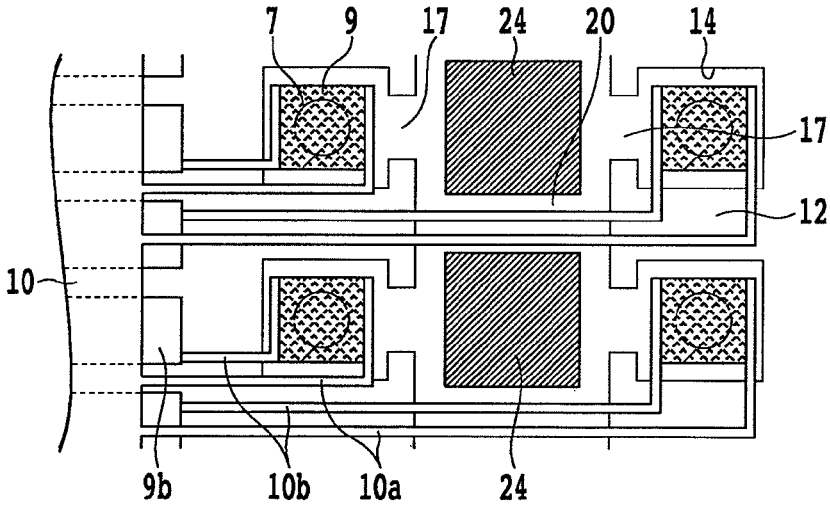
FIG. 9D is an enlarged view of an area in FIG. 9C which is shown by a dashed line.

FIG. 9A is a plan view showing the arrangement of the ejection openings, pressure chambers, channels, and ink supply ports in the print head shown in FIGS. 8A and 8B. FIG. 9B is a sectional view taken along line IXB-IXB in FIG. 9A. The ejection openings 7 shown by circles in FIG. 9A are actually formed in the orifice plate 3 and not on the substrate 2. However, the ejection openings 7 are shown in order to illustrate the positional relationship with the pressure chambers and the like. This also applies to the other figures described below. Moreover, FIG. 9C is a plan view showing an arrangement in which driving circuits, power supply wirings and heaters are added to the arrangement shown in FIG. 9A. FIG. 9D is an enlarged view of an area of the arrangement in FIG. 9C which is shown by a dashed line.

As shown in FIGS. 9A and 9B, the print head according to the present embodiment includes the plurality of ink supply ports 24. The plurality of supply ports 24 form two supply port arrays. The adjacent supply ports 24 in each of the arrays are separated from each other by beam portions 20. Furthermore, the pressure chambers 14 are provided on the respective both sides of each of the supply ports 24. Thus, basically, ink is fed from one supply port 24 to the pressure chambers 14 located on the respective both sides of the supply port 24, that is, a total of two pressure chambers 14. Each of the pressure chambers 14 includes the heater 9, serving as an ejection energy generating element. The ejection opening 7 is provided at a position on the orifice plate which corresponds to the heater. The plurality of supply ports 24 are formed so as to penetrate the substrate 2 in the thickness direction thereof. The supply ports 24 do not communicate at least in the substrate 2 with each other and are configured as independent holes. Each of the supply ports 24 communicates with a common liquid chamber 5. Furthermore, the channels 17 extend on the respective both sides of the common liquid chamber 5 so as to communicate with the common liquid chamber 5. The pressure chamber 14 communicates with an end of each of the channels 17 which is opposite to the common liquid chamber 5.

The arrays of the ejection openings 7 are such that for each of the supply ports 24 in the left one of the two arrays, the ejection openings 7 on the respective both sides of the supply port 24 are arranged at the same position in the direction along the supply port array as shown in FIG. 9A. Furthermore, for each of the supply ports 24 in the right supply port array, the ejection openings 7 on the respective both sides of the supply port 24 are arranged at the same position in the above-described direction. The thus arranged ejection opening arrays corresponding to the right and left supply port arrays are displaced from each other by half an ejection opening arrangement pitch. Thus, in the print head according to the present embodiment, the four ejection opening arrays are provided for one ink color, and the print head performs scanning in a direction orthogonal to the direction along the ejection opening arrays. Thus, since two sets of ejection opening arrays are displaced from each other by half a pitch, the print resolution in the direction orthogonal to the scanning direction can be made equal to double the ejection opening arrangement pitch. Furthermore, for example, ink can be ejected to the same pixel through the ejection openings located at the same position in the ejection opening arrangement direction so that a dot for the pixel can be formed of up to two ink droplets. Alternatively, the left one, in FIG. 9A, of the two ejection opening arrays corresponding to the left supply port arrays may be used for scanning in one direction, whereas the two ejection opening arrays corresponding to the right supply port arrays may be used for scanning in the opposite direction.

In FIGS. 9C and 9D, to each of the heaters 9, a power supply-heater wiring 10*a* connecting the heater 9 to the power supply wiring 10 and a heater-driving circuit wiring 10*b* connecting the heater 9 to the driving circuit 11 are connected. For each of the supply ports 24, parts of the power supply-heater wiring 10*a* and heater-driving circuit wiring 10*b* for the heater 9 located on the right side of the supply port 24 are provided on the beam portion 20 below the supply port 24. Thus, the wirings for the right side heater are laid out utilizing the beam portion 20, which separates the supply ports 24 from each other.

Figure 4A:
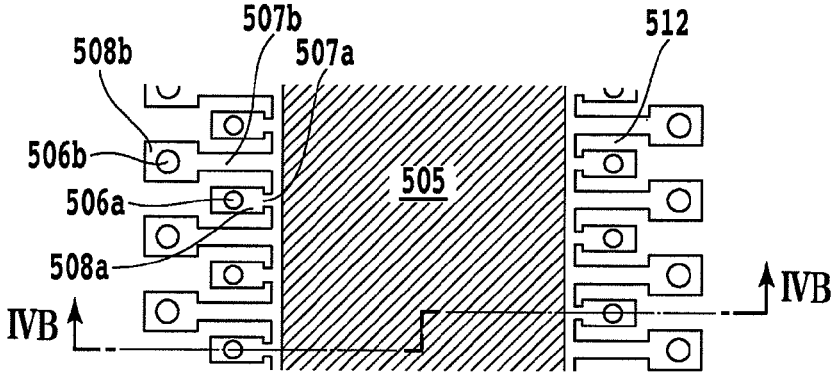
FIG.4A PRIOR ART
FIG. 4A is view showing another conventional example of a print head.
Figure 4B:
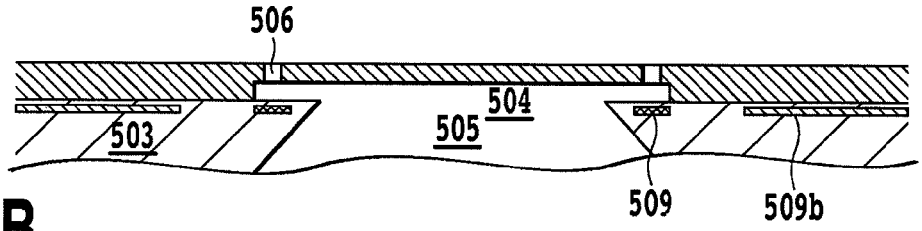
FIG.4B PRIOR ART
FIG. 4B is view showing another conventional example of a print head.
Figure 4C:
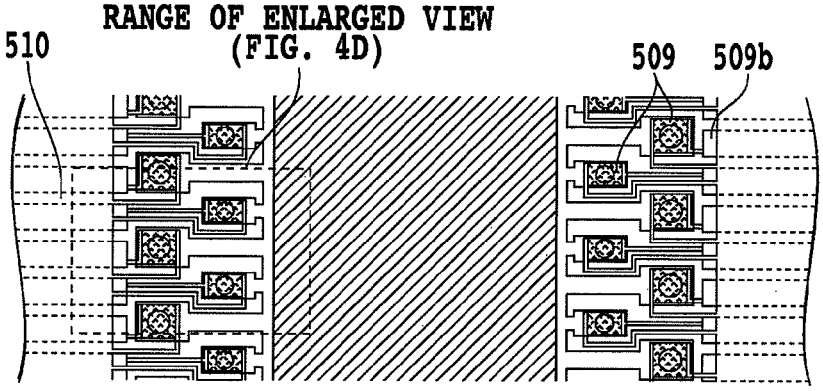
FIG.4C PRIOR ART
FIG. 4C is view showing another conventional example of a print head.
Figure 4D:
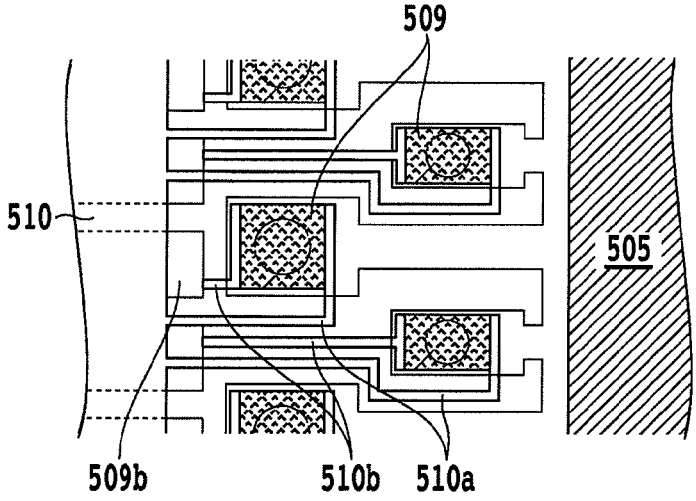
FIG.4D PRIOR ART
FIG. 4D is view showing another conventional example of a print head.

As described above, according to the present embodiment, the plurality of supply ports are provided to supply ink to the channels and the pressure chambers and separated from one another by the beam portions. Thus, the ejection structures each including the channel, pressure chamber, heater, ejection opening can be arranged on the respective both sides of each supply port. Consequently, even if the ejection structures are relatively densely arranged, the channel, the pressure chamber, the heater, and the like can have necessary and sufficient sizes and locations without suffering restrictions associated with the arrangement. Specifically, the arrangement in the conventional example shown in FIG. 4C and the arrangement in the present embodiment shown in FIG. 9C are provided in the same area. As is apparent from these figures, almost the same number of heaters can be arranged in the same area, that is, the heaters can be arranged at the same arrangement density. In this case, compared to the conventional art, the present embodiment provides the plurality of small supply ports, thus enabling the channels, pressure chambers, heaters, and the like to be efficiently arranged. As a result, the channels, pressure chambers, heaters, and the like to be efficiently arranged in a sufficient area with the arrangements of the channels, pressure chambers, heaters, and the like prevented from restricting one another. Thus, a print head can be provided which enables the refill frequency to be improved.

Furthermore, the wirings connecting the heater to the power supply and connecting the heater to the driving circuit together can be arranged without suffering the above-described restrictions associated with the arrangement. The wirings are laid out on the beam portions, serving as partition walls for the supply ports. This enables wiring to be achieved by efficiently utilizing the arrangement of the plurality of supply ports.

When the heaters and the ejection openings are densely arranged, the scales of the driving circuit 9*b* and the logic circuit 9*c* need to be correspondingly increased. However, the area occupied by the circuits can be reduced compared to that in the individual arrangement of arrays each comprising a supply port, heaters, driving circuits, and logic circuits. More specifically, compared to the case in which two arrangement units shown in FIG. 3 are provided so that the number of ejection openings in the arrangement units is comparable to that in one arrangement unit shown in FIG. 9, the arrangement according to the present embodiment allows a reduction in the area of the substrate. The arrangement area required for two supply ports in the individual arrangement of the two arrays can be reduced to half, thus enabling a reduction in substrate area. Furthermore, the layout of the driving circuit and logic circuit in an array allows a reduction in arrangement area compared to the arrangement in which the driving circuits and the logic circuits are arranged in different arrays. This is because an efficient layout can be obtained by arranging the components of the driving circuit and logic circuit in an array. A specific example will be described in which MOS transistors are used as the driving circuits. A drain electrode of each of the MOS transistors is connected to a power supply potential via the heater. A source electrode of the MOS transistor is connected to a ground potential. The drain electrodes of the MOS transistors need to be independently arranged for the respective heaters. On the other hand, the source electrode can be shared by the adjacent MOS transistors. The sharing of the source electrode the adjacent MOS transistors enables a reduction in arrangement area compared to the individual arrangement of the source electrodes. Additionally, also when logic circuits are provided, the source electrode can be shared by the adjacent logic circuits or the power supply wiring can be shared through which the power supply potential is supplied to the logic circuits. Thus, the present arrangement enables an increase in substrate size to be inhibited compared to the arrangement of the logic circuits in the different arrays.

Embodiment 2

A second embodiment of the present invention relates to an arrangement in which one supply port array is further located in the central portion between the two supply port arrays shown in FIG. 9 so that each pressure chamber adjacent to the central supply port array is fed with ink both from the adjacent supply port in the central supply port array and from the opposite, adjacent supply port in one of the original two supply port arrays.

Figure 10A:
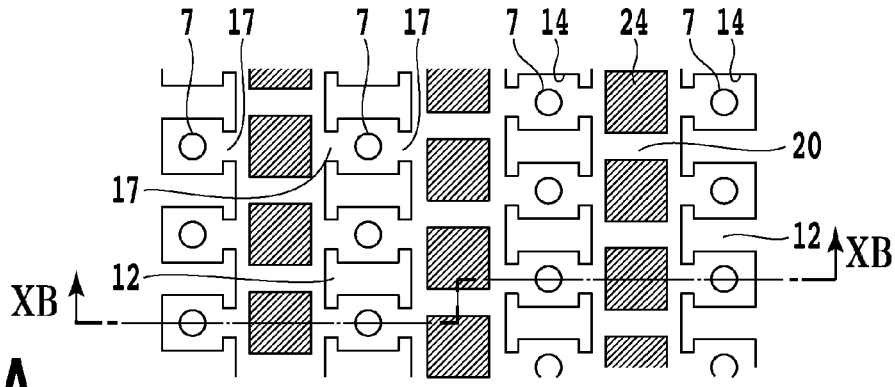
FIG. 10A is a plan view showing the arrangement of ejection openings, pressure chambers, channels, and supply ports in a print head shown according to a second embodiment of the present invention.
Figure 10B:
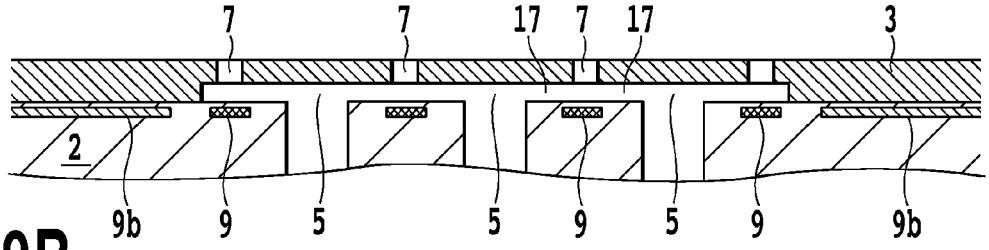
FIG. 10B is a sectional view taken along line XB-XB in FIG. 10A.
Figure 10C:
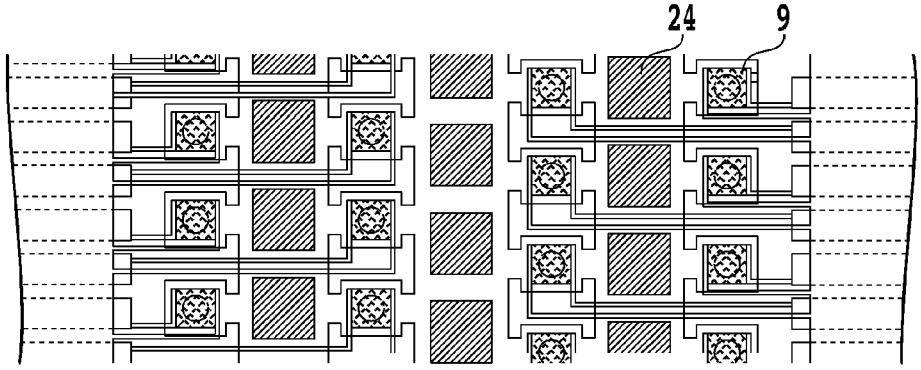
FIG. 10C is a plan view of the configuration shown in FIG. 10A and to which driving circuits, power supply wirings, and heaters are added.
Figure 10D:
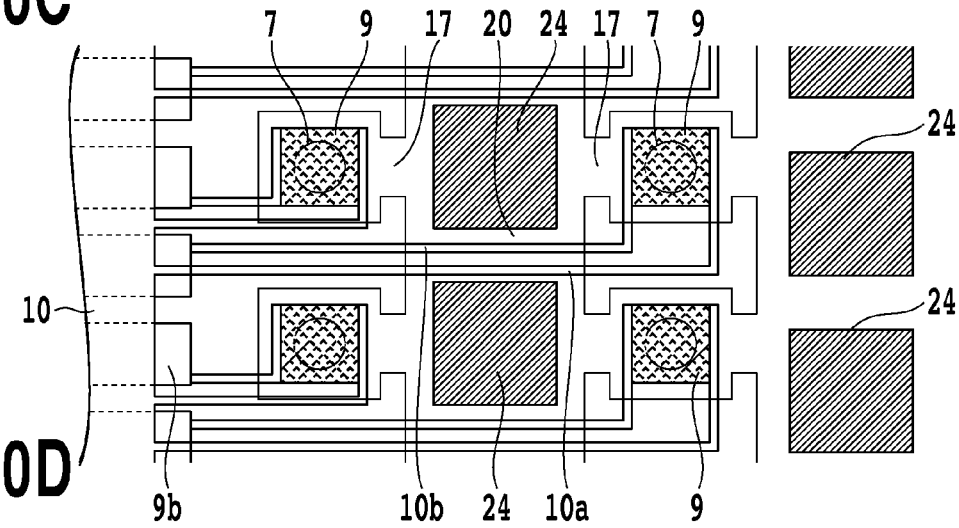
FIG. 10D is an enlarged view of a partial area of the configuration shown in FIG. 10C.

FIG. 10A is a plan view showing the arrangement of ejection openings, pressure chambers, channels, and supply ports in a print head according to a second embodiment of the present invention. FIG. 10B is a sectional view taken along line XB-XB in FIG. 10A. Moreover, FIG. 10C is a plan view of a configuration in which driving circuits, power supply wirings, and heaters are added to the configuration shown in FIG. 10A. FIG. 10D is an enlarged view of a partial area of the configuration shown in FIG. 10C.

In the above-described first embodiment, the four ejection opening arrays are arranged for the two support port arrays. On the other hand, four ejection opening arrays are arranged for three support port arrays. Furthermore, in the inner two of the four ejection opening arrays, the pressure chamber 14 corresponding to each ejection opening 7 communicates with two channels 17 arranged on the respective both sides of the pressure chamber 14. That is, each ejection opening in the inner two ejection opening arrays is fed with ink from the opposite, adjacent supply ports via the respective channels 17.

In the present embodiment, the pressure chamber 14 and the opposite channels 17 have a symmetric shape. This allows the ejection characteristics of the central two ejection opening arrays to be improved. More specifically, heaters 9 are arranged opposing each of the ejection openings 7 in the two ejection opening arrays according to the present embodiment. The adjacent and opposite supply ports 24 are formed such that the distance from the edge of each of the ink supply ports 24 to the edge of the ejection opening 7 closest to the ink supply port 24 is equal between the supply ports 24. That is, fluid paths from the ejection opening 7 to the respective supply ports 24 are symmetrical formed with respect to the ejection opening 7.

The print head according to the above-described second embodiment can not only exert the same effects as those of the above-described first embodiment but also produce the following particular effects.

The arrangement of the supply ports 24 allow ink to be fed through the two channels 17 arranged on the respective both sides of each pressure chamber 14, and allow bubbles resulting from heat generated by the heater 7 to grow and contact symmetrically with respect to the ejection openings. Specifically, when the heaters 9 are energized, electric energy is converted into heat to allow the heaters 9 to generate heat. Thus, inside the pressure chamber 14, in which the heater 9 is provided, the ink positioned above the heater 9 is subjected to film boiling, thus generating a bubble. When the bubbles are generated inside the pressure chamber 14, pressure is exerted to push the ink toward the ejection opening 7 positioned above the heater 9. The ink is then ejected through the ejection opening. In conjunction with the ejection, ink is supplied to the pressure chamber 14 through the supply port 24 via the common liquid chamber 5. Here, the supply port 24 through which the ink is fed to the pressure chamber 14 via the common liquid chamber 5 is provided on each of the both sides of the ejection opening 7. Therefore, the ejection opening 7 is supplied with the ink through the supply ports 24 arranged on the respective both sides of the ejection opening 7 across the pressure chamber 14. This allows the ink to be fed to the ejection opening 7 in a balanced manner instead of limiting the flow of the ink fed to the ejection opening 7 to one direction. Furthermore, in the present embodiment, each of the supply ports 24 is formed such that the distance from the edge of the supply port 24 to the edge of the ejection opening (the bottom of the pressure chamber on which the ejection opening 7 is projected) closest to the ink supply port 24 is substantially equal between the adjacent supply ports 24. Furthermore, for each ejection opening 7, the channels to the supply ports 24 are symmetrically with respect to the ejection opening 7.

In the above-described configuration, mainly because the ink is fed to the ejection opening 7 via the channels arranged on the respective both sides of the ejection opening 7, the refill frequency for the ejection openings can be increased.

Furthermore, since the bubbles can be grown and contracted symmetrically with respect to the ejection opening 7, the ejection can be stably maintained in one direction. That is, conditions such as a loss in the channel from the supply port 24 to the pressure chamber 14 are the same for all the ejection openings. Thus, the conditions such as the flow rate and flow velocity of the ink fed to the ejection opening 7 during ejection and the flow resistance of the ink pushed back when the bubble grows are substantially equal among the ejection openings, inhibiting the grow of the bubble from being limited to a certain direction. The contraction of the bubble is also prevented from being limited to a certain direction and is directed toward the center of the heater 9 in a well-balanced manner. As a result, the trail of the ejected ink is thick and straight, enabling an increase in the size of satellites resulting from splitting of the trail. Thus, the satellites also fly along the ejection direction. In this case, the plurality of satellites fly in the same direction. Thus, the satellites are united into a further larger satellite. Furthermore, the main droplet portion also flies along the ejection direction.

As described above, the increased size of the satellites makes the impact positions of the satellites unlikely to be affected by air flows. The density is prevented from varying even during high-speed printing or printing with small droplets. This in turn makes density unevenness unlikely to occur in the image. Furthermore, the increased size of the satellites increases the rate at which the satellite successfully reaches the print medium. As a result, the amount of mist floating between the print head and the print medium decreases.

Embodiment 3

A third embodiment of the present invention corresponds to an arrangement in which a supply port array is provided outside and adjacent to the otherwise outermost ejection opening array in the arrangement of the supply port array and the like according to the above-described second embodiment.

Figure 11A:
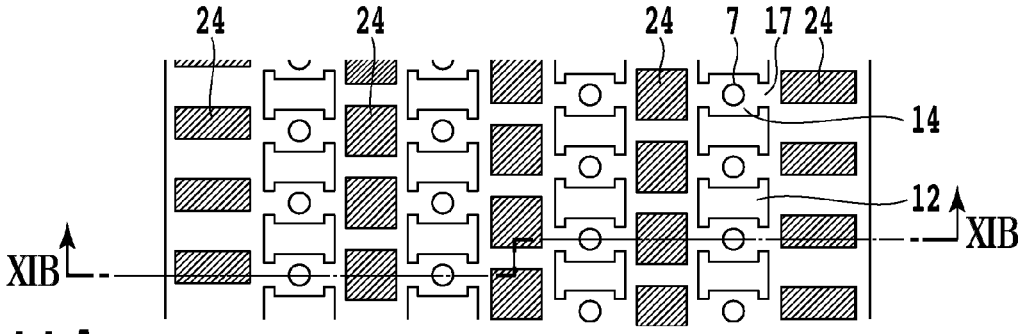
FIG. 11A is a view illustrating a third embodiment of the present invention and is similar to FIG. 10A illustrating the second embodiment.
Figure 11B:
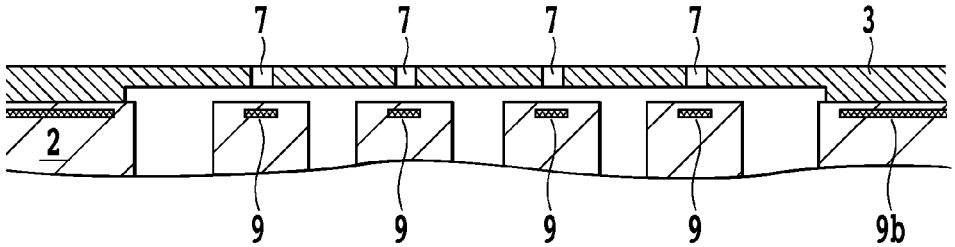
FIG. 11B is a view illustrating the third embodiment of the present invention and is similar to FIG. 10B illustrating the second embodiment.
Figure 11C:
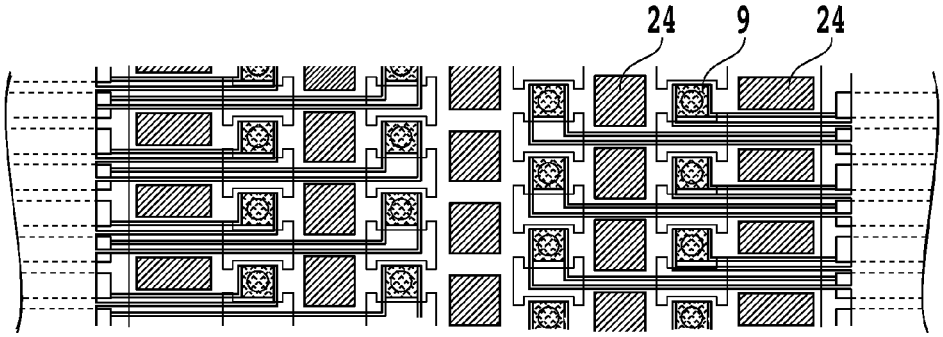
FIG. 11C is a view illustrating the third embodiment of the present invention and is similar to FIG. 10C illustrating the second embodiment.
Figure 11D:
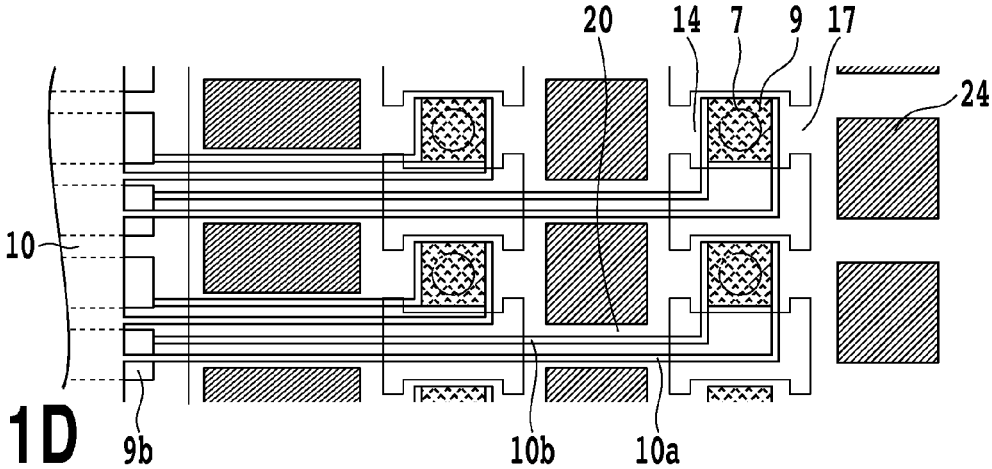
FIG. 11D is a view illustrating the third embodiment of the present invention and is similar to FIG. 10D illustrating the second embodiment.

FIGS. 11A to 11D are views similar to FIGS. 10A to 10D illustrating the second embodiment. In particular, as shown in FIG. 11A, arrays of the supply ports 24 are provided on the respective laterally-both sides of a set of four arrays of the ejection opening arrays 7. This results in a channel structure symmetric with respect to all the ejection openings.

Since the channels are symmetric with respect to all the ejection openings as described above, the refill frequency is expected to be improved for the whole print head. Furthermore, the satellites can be reduced by decreasing the above-described channel cross section.

Embodiment 4

A fourth embodiment of the present invention corresponds to the arrangement of the supply ports and the like according to the above-described third embodiment in which the power supply-heater wiring 10*a* is shared by two heaters 9.

Figure 12A:
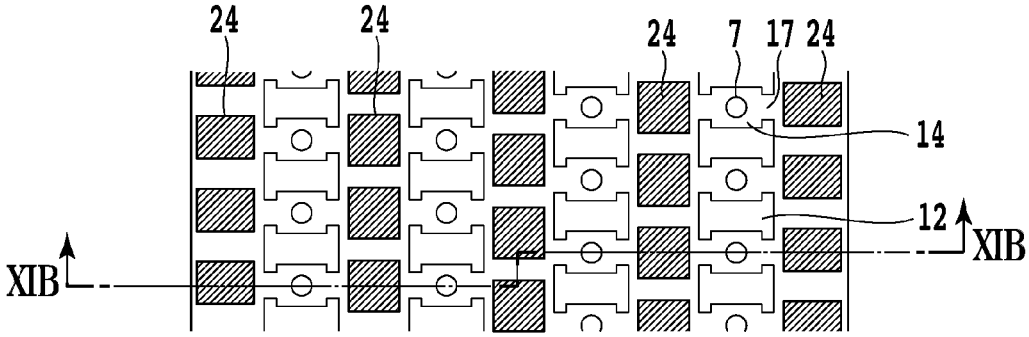
FIG. 12A is a view illustrating a fourth embodiment of the present invention and is similar to FIG. 11A illustrating the third embodiment.
Figure 12B:
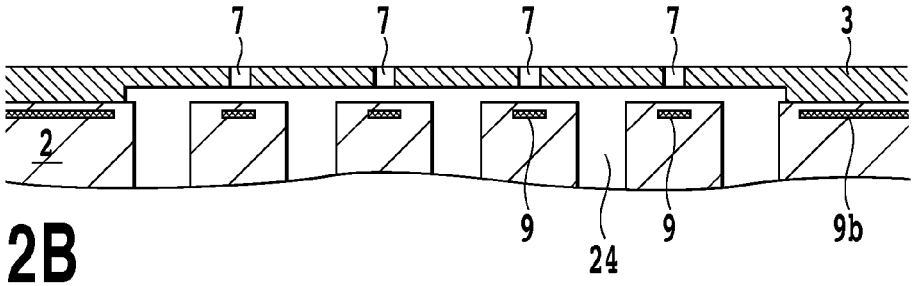
FIG. 12B is a view illustrating the fourth embodiment of the present invention and is similar to FIG. 11A illustrating the third embodiment.
Figure 12C:
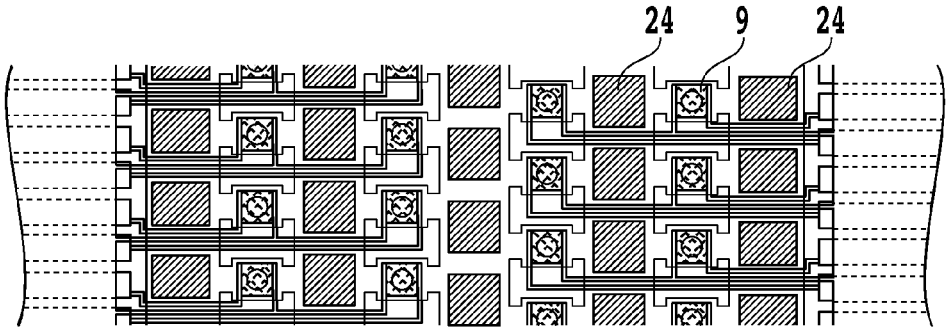
FIG. 12C is a view illustrating the fourth embodiment of the present invention and is similar to FIG. 11C illustrating the third embodiment.
Figure 12D:
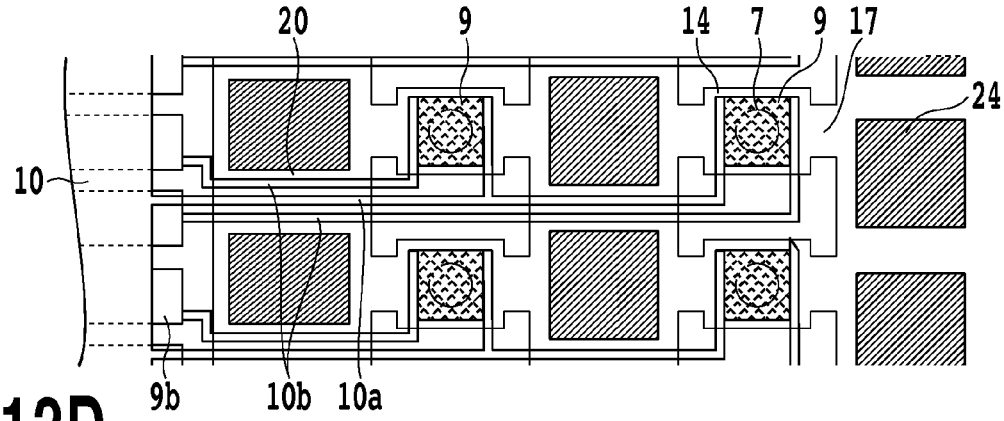
FIG. 12D is a view illustrating the fourth embodiment of the present invention and is similar to FIG. 11D illustrating the third embodiment.

FIGS. 12A to 12D are views similar to FIGS. 11A to 11D illustrating the third embodiment. In particular, as shown in FIG. 12D, the power supply-heater wiring 10*a* is shared by the heaters 9 corresponding to two ejection openings arranged in the lateral direction of FIG. 12A and belonging to the first and second ones of the four ejection opening arrays from the left thereof. The power supply-heater wiring 10*a* is also shared by the heaters 9 corresponding to two ejection openings arranged in the lateral direction of FIG. 12A and belonging to the third and fourth ones of the four ejection opening arrays from the left thereof.

Thus, sharing of the wiring enables a reduction in the width of the area on the beam portion 20 in which the wiring is provided. As a result, if the wiring is provided on the beam portion 20, the degree of freedom of the design of the width of the beam portion is increased. For example, the width of the beam portion can be minimized to reduce the size of the substrate.

Embodiment 5

A fifth embodiment of the present invention corresponds to the arrangement of the supply ports and the like according to the above-described fourth embodiment in which the wirings for the heater are provided in multiple layers.

Figure 13A:
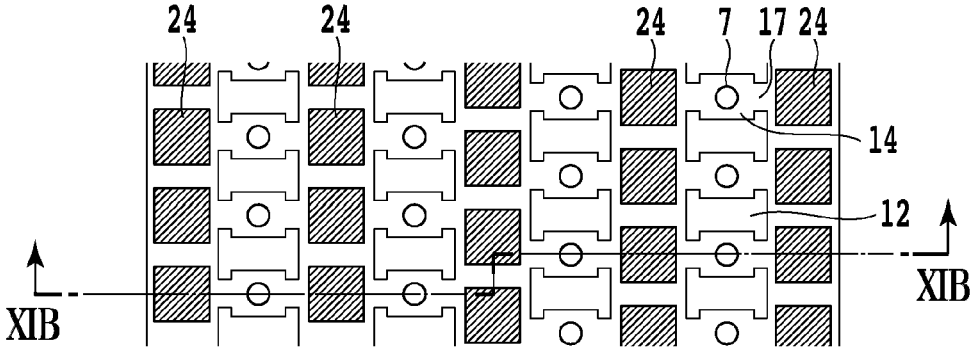
FIG. 13A is a view illustrating a fifth embodiment of the present invention and is similar to FIG. 12A illustrating the fourth embodiment.
Figure 13B:
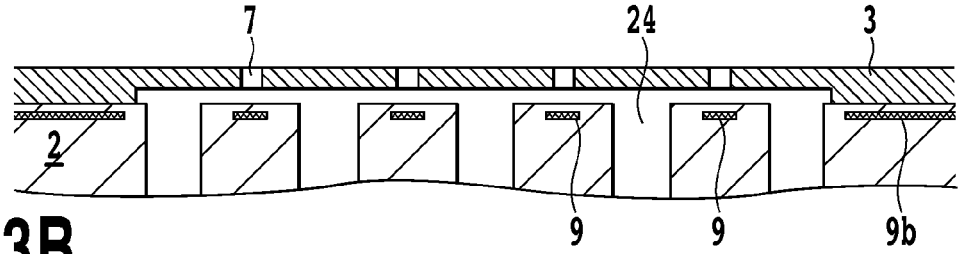
FIG. 13B is a view illustrating the fifth embodiment of the present invention and is similar to FIG. 12B illustrating the fourth embodiment.
Figure 13C:
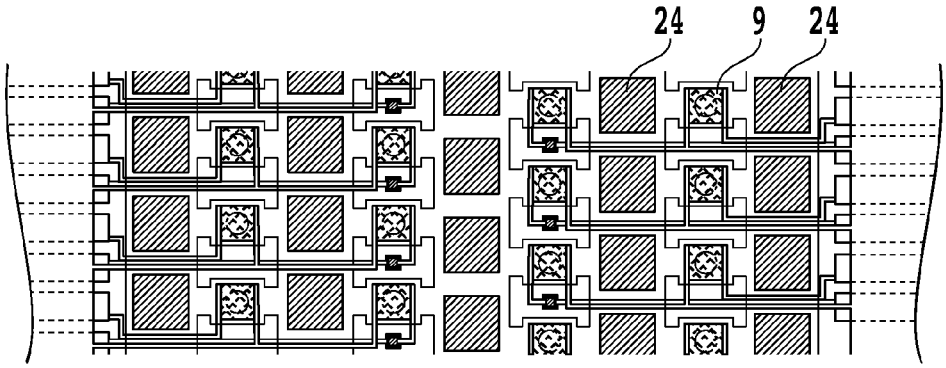
FIG. 13C is a view illustrating the fifth embodiment of the present invention and is similar to FIG. 12C illustrating the fourth embodiment.
Figure 13D:
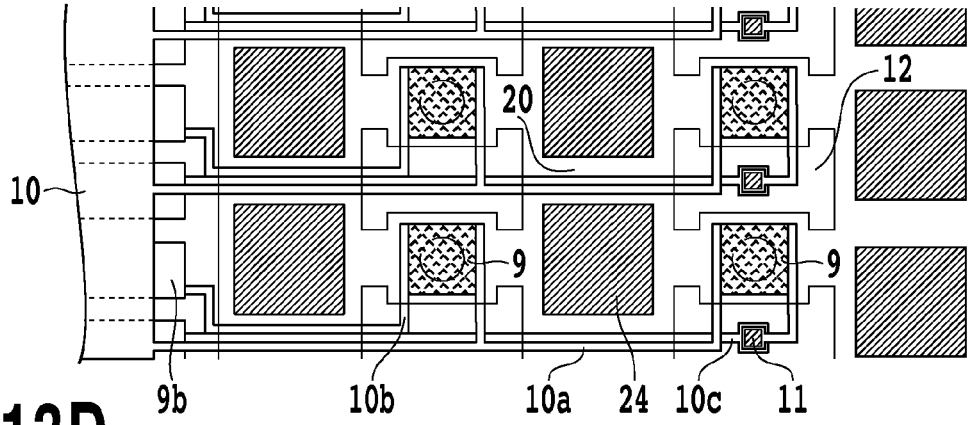
FIG. 13D is a view illustrating the fifth embodiment of the present invention and is similar to FIG. 12D illustrating the fourth embodiment.

FIGS. 13A to 13D are views similar to FIGS. 12A to 12D illustrating the fourth embodiment. In particular, as shown in FIG. 13D, the power supply-heater wiring 10*a* is provided on an upper layer of the substrate as in the case with the above-described embodiments. In contrast, for the two heaters provided on the respective both sides of a supply port 24, the heater-driving circuit wiring 10*c* connecting the heater 9 far from the driving circuit 9*b* to the driving circuit 9*b* is provided inside the substrate. The heater-driving circuit wiring 10*b* connecting the closer heater 9 to the driving circuit 9*b* is provided on the upper layer of the substrate as is the case with the above-described embodiments. That is, in the present embodiment, the wiring connecting the power supply wiring 10 to the heater 9 and (a part of) the wiring connecting the heater 9 to the driving circuit 9*b* are arranged to form the multiple layers in the substrate. In other words, the power supply-heater wiring 10*a* and the like need not necessarily be arranged on the upper layer of the substrate but at least two types of wirings may be arranged to form multiple layers.

In the present embodiment, to allow the wirings to be arranged to form multiple layers, the heater-driving circuit wiring 10*c* and a through-hole 11 are provided near the farther heater 9; the heater-driving circuit wiring 10*c* is provided inside the substrate, and the through-hole 11 is electrically connected to the wiring from the heater 9. A partition wall 12 is provided above the position on the substrate where the through-hole 11 is formed. Thus, a relatively steep step portion on the substrate resulting from the formation of the through-hole can be covered with the partition wall. Consequently, possible exposure of the step portion to the ink can be avoided. That is, such a steep portion tends to have a surface protection film with degraded coverability and is expected to fail to ensure long-term reliability when exposed to the ink. To prevent this, an additional manufacturing process is required such as an additional flattening process for preventing the formation of a steep portion or coverage with a firmer protection film. This increases costs. However, the configuration shown in the present embodiment allows such adverse effects to be inhibited.

Like the fourth embodiment, the above-described fifth embodiment enables a reduction in the width of the area on the beam portion 20 in which the wiring is provided. As a result, if the wiring is provided on the beam portion 20, the degree of freedom of the design of the width of the beam portion is increased. For example, the width of the beam portion can be minimized to reduce the size of the substrate.

Embodiment 6

A sixth embodiment of the present invention corresponds to the configuration in which the wirings for the heater are provided in multiple layers as in the above fifth embodiment and in which the through-hole through which the wirings are connected together is formed on each beam portion configured to separate the supply ports in the central supply port array from each other, with the beam portion covered with a cover wall.

Figure 14A:
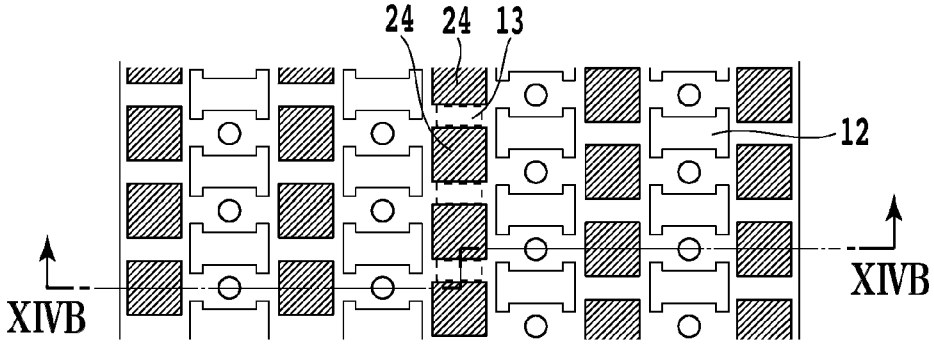
FIG. 14A is a view illustrating a sixth embodiment of the present invention and is similar to FIG. 13A illustrating the fifth embodiment.
Figure 14B:
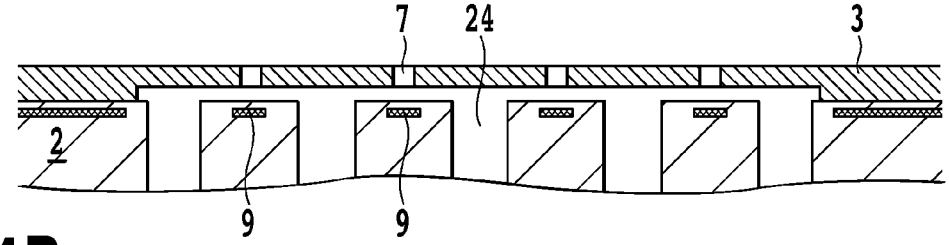
FIG. 14B is a view illustrating the sixth embodiment of the present invention and is similar to FIG. 13B illustrating the fifth embodiment.
Figure 14C:
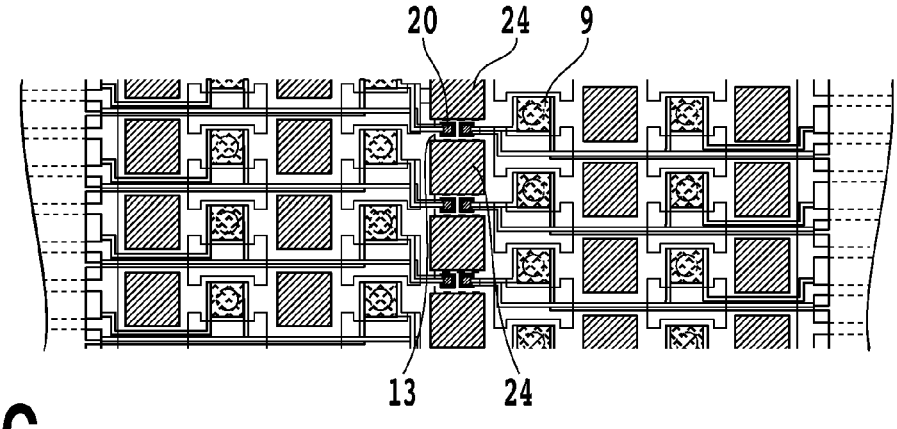
FIG. 14C is a view illustrating the sixth embodiment of the present invention and is similar to FIG. 13C illustrating the fifth embodiment.
Figure 14D:
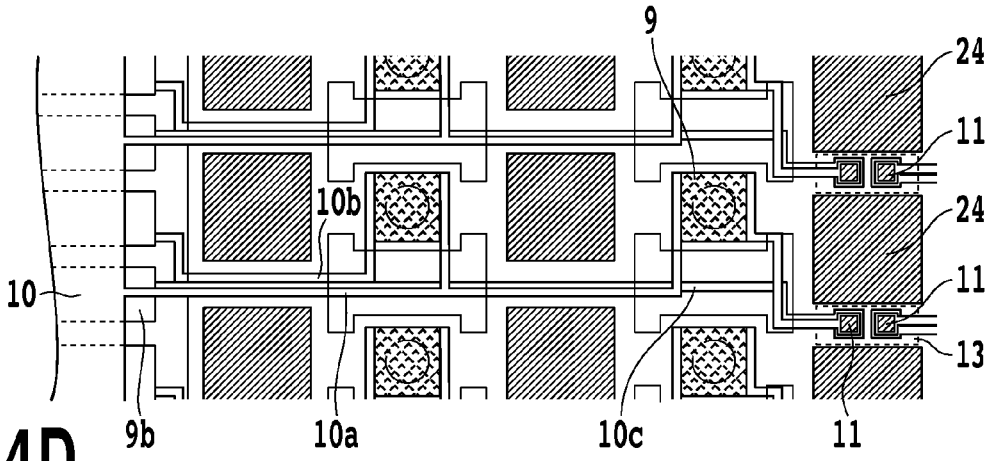
FIG. 14D is a view illustrating the sixth embodiment of the present invention and is similar to FIG. 13D illustrating the fifth embodiment.

FIGS. 14A to 14D are views illustrating similar to FIGS. 13A to 13D illustrating the fifth embodiment. As shown in FIG. 14D, the through-hole 11 through which the heater-driving circuit wiring 10*c* provided inside the substrate and the wiring from the heater 9 are electrically connected together is provided on each beam portion configured to separate the supply ports 24 in the central one of five supply port arrays (FIG. 14A) from each other. A cover wall 13 is formed on the beam portion so as to cover the through-hole 11. This configuration allows effects similar to those of the above-described fifth embodiment to be exerted, and in particular, allows the location and size of the heater and the like to be determined without being affected by the formation of the through-hole. For example, relatively large heaters and pressure chambers can be provided.

Embodiment 7

A seventh embodiment of the present invention corresponds to the arrangement of the heaters and the like according to the above-described fifth embodiment in which on each side of the pressure chambers, one supply port corresponds to two pressure chambers is provided.

FIGS. 15A to 15D are views similar to FIGS. 13A to 13D illustrating the fifth embodiment. In the present embodiment, in particular, one supply port 24 corresponds to two pressure chambers 14 (and the ejection opening 7) provided on each of the both sides of the supply port 24 so that the two pressure chambers are fed with ink via the supply port.

Figure 15A:
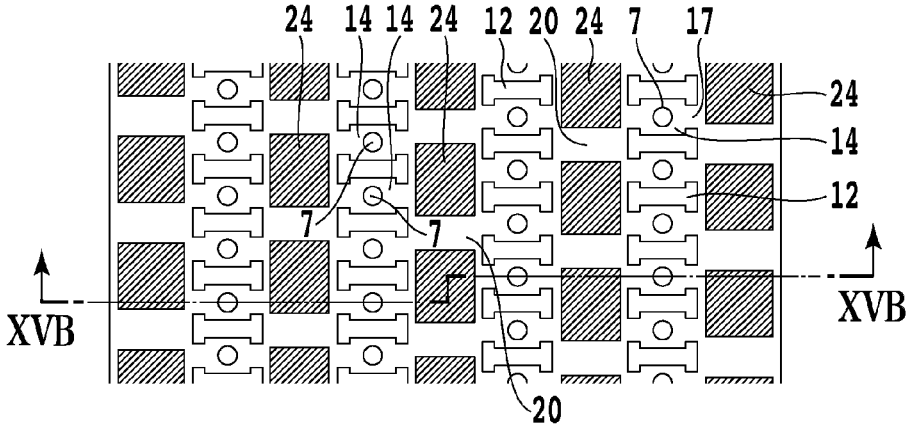
FIG. 15A is a view illustrating a seventh embodiment of the present invention and is similar to FIG. 13A illustrating the fifth embodiment.
Figure 15B:
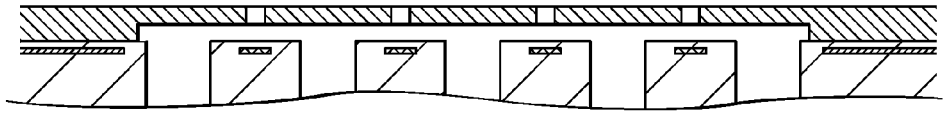
FIG. 15B is a view illustrating the seventh embodiment of the present invention and is similar to FIG. 13B illustrating the fifth embodiment.
Figure 15C:
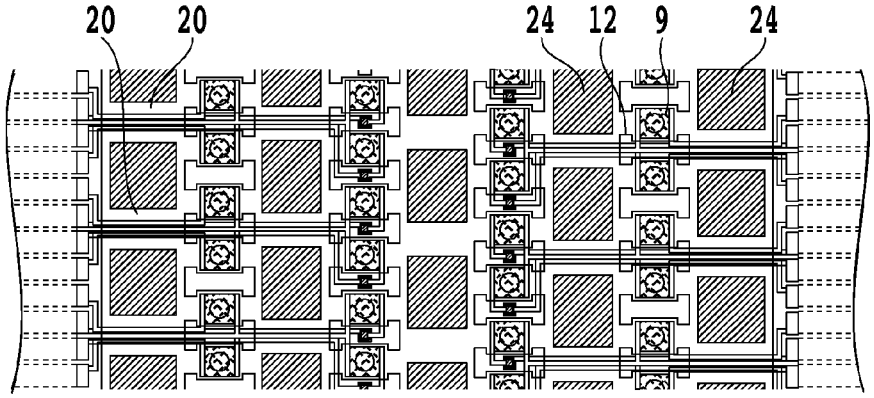
FIG. 15C is a view illustrating the seventh embodiment of the present invention and is similar to FIG. 13C illustrating the fifth embodiment.
Figure 15D:
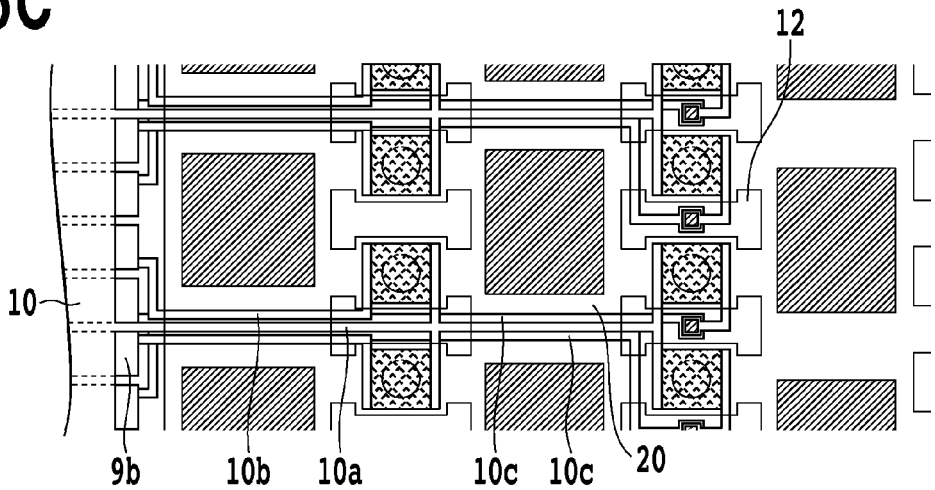
FIG. 15D is a view illustrating the seventh embodiment of the present invention and is similar to FIG. 13D illustrating the fifth embodiment.

Furthermore, if each supply port is shared by the pressure chambers as described above, then in some partition walls for the pressure chambers, the path of the wiring is blocked by the supply port 24 to prevent the wiring from being laid out. Thus, in particular, as shown in FIGS. 15C and 15D, the wiring is provided on every other beam portion 20, and the wirings for the two heaters are provided on one beam portion 20.

The above-described seventh embodiment not only exerts the effects of the above-described fifth embodiment but also enables relatively large supply ports to be provided. Thus, ink supply performance can be improved. It should be noted that though the above embodiment shows an example of providing the wirings for the two heaters on one beam portion, the number of heaters are not limited to two. Wirings for more than two heaters may be provided on one beam portion, and thus desired size of supply port can be provided.

Embodiment 8

An eighth embodiment of the present invention corresponds to the arrangement of the heaters and the like according to the above-described sixth embodiment in which each supply port is provided in association with two pressure chambers.

FIGS. 16A to 16D are views similar to FIGS. 14A to 14D illustrating the sixth embodiment. In the present embodiment, in particular, as shown in FIG. 16A, one supply port 24 corresponds to two pressure chambers 14 (and the ejection opening 7) provided on each of the both sides of the supply port 24 so that the two pressure chambers are fed with ink via the supply port. Furthermore, when each supply port is shared by the pressure chambers as described above, then in some partition walls for the pressure chambers, the path of the wiring is blocked by the supply port 24 to prevent the wiring from being laid out. Thus, in particular, as shown in FIGS. 16C and 16D, the wiring is provided on every other beam portion 20, and the wirings for the two heaters are provided on one beam portion 20. Consequently, two sets of through-holes 11 corresponding to two heaters 9 are formed in the same beam portion for the corresponding supply port in the central supply port array.

The above-described eighth embodiment not only exerts the effects of the above-described sixth embodiment but also enables relatively large supply ports to be provided. Thus, ink supply performance can be improved.

Figure 17:
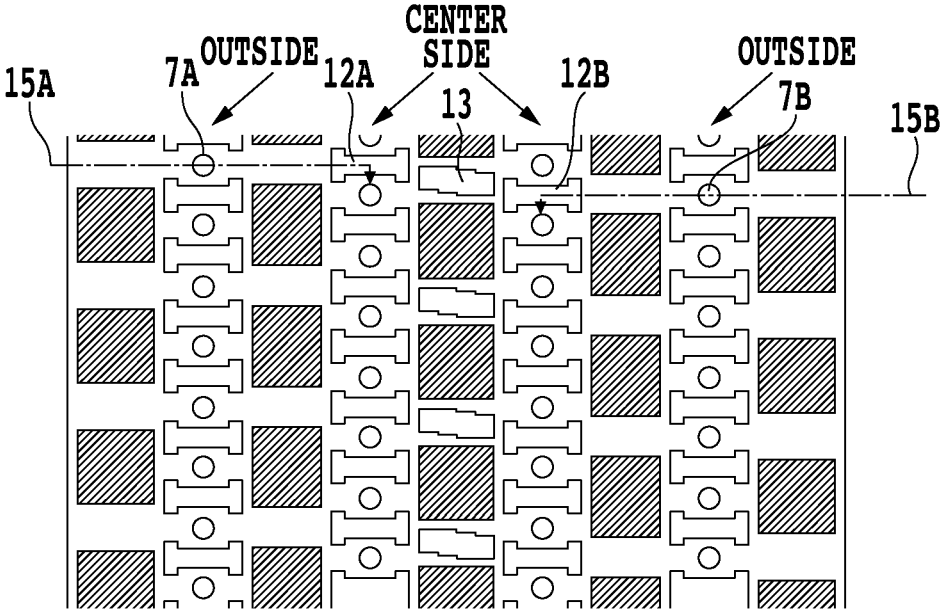
FIG. 17 is a view illustrating a variation of the eighth embodiment of the present invention.

As shown in FIG. 17, an ejection opening 7A in an outer ejection opening array and a partition wall 12A in a central ejection opening array are arranged almost on a straight line. Furthermore, an ejection opening 7B in an outer ejection opening array and a partition wall 12B in a central ejection opening array are arranged almost on a straight line. Then, each of the wirings can be provided below the heater corresponding to the outer ejection opening. That is, the wirings are provided along the respective paths shown by alternate long and short dash lines 15A and 15B, with a part of each wiring located below the heater. This enables an increase in the degree of freedom of the location and size of the heater.

Other Embodiments

In the above-described embodiments, the present invention has been described taking the print head configured to eject ink, for instance. However, of course, the application of the present invention is not limited to this aspect. The present invention is applicable to, for example, a liquid ejection head configured to eject a liquid that coagulates pigments used as ink color materials. In the specification, a head configured to eject such a liquid or the above-described ink is defined as a liquid ejection head.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-026476, filed Feb. 6, 2009, which is hereby incorporated by reference herein in its entirety.

REFERENCE SIGNS LIST

2 Substrate
3 Orifice plate
7 Ejection opening
9 Heater
9*b* Driving circuit
10 Power supply wiring
10*a* Power supply-heater wiring
10*b*, 10*c* Heater-driving circuit wiring
11 Through-hole
12 Partition wall
13 Cover wall
14 Pressure chamber
24 Supply port

The invention claimed is:

1. A liquid ejection head for ejecting liquid, comprising:

a plurality of supply ports through which the same kind of liquid is supplied to pressure chambers, each of which communicates with an ejection opening and in each of which an ejection energy generating element is provided, each of the plurality of supply ports being formed as a hole passing through a substrate;

beam portions configured to separate the plurality of supply ports from each other; and wirings provided in the beam portions, the wirings being used for driving the ejection energy generating elements.

2. The liquid ejection head as claimed in claim 1, wherein respective pressure chambers are located on both sides of each of the supply ports through which the liquid is supplied to the pressure chambers, and the wirings provided in the beam portions are wirings used for driving the ejection energy generating elements in the pressure chambers.

3. The liquid ejection head as claimed in claim 2, wherein among the wirings used for driving the ejection energy generating elements in the respective pressure chambers supplied with the liquid, wirings from a power supply are shared by the ejection energy generating elements.

4. The liquid ejection head as claimed in claim 1, wherein respective supply ports are provided on both sides of a respective pressure chamber and the liquid is supplied to the respective pressure chamber from the respective supply ports.

5. The liquid ejection head as claimed in claim 1, wherein the wirings form multiple layers in the substrate.

6. The liquid ejection head as claimed in claim 5, further comprising a through-hole for connecting the wirings forming the multiple layers to each other, the through-hole being provided between the adjacent ejection energy generating elements and a partition wall for separating the pressure chambers from each other being provided on the through-hole.

7. The liquid ejection head as claimed in claim 5, further comprising a through-hole for connecting the wirings forming the multiple layers to each other, the through-hole being provided on one of the beam portions configured to separate the supply ports.

8. The liquid ejection head as claimed in claim 7, wherein a cover wall is provided on the one beam portion configured to separate the supply ports.

9. The liquid ejection head as claimed in claim 1, wherein the wirings used for driving two ejection energy generating elements are provided in one of the beam portions formed between the plurality of supply ports.

10. The liquid ejection head as claimed in claim 1, wherein a part of the wirings is provided on a lower side of the ejection energy generating elements.

11. A liquid ejection head comprising:

a plurality of pressure chambers provided correspondingly to a plurality of ejection openings for ejecting liquid, the plurality of pressure chambers including energy generating elements for generating energy used for ejecting the liquid; and a substrate provided with a supply port array in which a plurality of supply ports, each of which is formed as a hole passing through the substrate and is configured to supply the liquid to the pressure chambers, are arrayed and an energy generating element array which is opposed to the supply port array and in which a plurality of the energy generating elements are arrayed, wherein wirings used for driving the energy generating elements are formed in beam portions, each of which being formed between adjacent supply ports in the supply port array.

12. An ink jet printing apparatus that performs printing by using a print head for ejecting ink, wherein the print head comprises:

a plurality of supply ports through which the same kind of ink is supplied to pressure chambers, each of which communicates with an ejection opening and in each of which an ejection energy generating element is provided, each of the plurality of supply ports being formed as a hole passing through a substrate;

beam portions configured to separate the plurality of supply ports from each other; and wirings provided in the beam portions, the wirings being used for driving the ejection energy generating elements.

13. A liquid ejection head comprising:

a member provided with a plurality of ejection openings for ejecting liquid;

a substrate provided with first and second element arrays, in each of which a plurality of energy generating elements for generating energy used for ejecting the liquid are arrayed in a first direction, and a supply port array in which a plurality of supply ports for supplying the liquid to the plurality of energy generating elements are arrayed in the first direction, each of the plurality of supply ports being formed as a hole passing through the substrate, wherein the first element array, the supply port array and the second element array are arrayed in this order in a second direction that intersects with the first direction; and wirings that are connected to the energy generating elements of the second element array in order to drive the energy generating elements extends toward the first element array through spaces between the supply ports of the supply port array.

14. The liquid ejection head as claimed in claim 13, wherein the wirings pass between the energy generating elements of the first element array to be connected to electrodes.

15. The liquid ejection head as claimed in claim 13, further comprising a second supply port array in which a plurality of supply ports are arrayed in the first direction and which is arranged on an opposite side of the second element array from the supply port array.

16. The liquid ejection head as claimed in claim 15, wherein to the second element array, liquid is supplied from supply ports of the supply port and second supply port arrays.

17. The liquid ejection head as claimed in claim 13, further comprising a through-hole for connecting the wirings forming multiple layers to each other in the substrate.

18. The liquid ejection head as claimed in claim 17, further comprising a second supply port array in which a plurality of supply ports are arrayed in the first direction and which is arranged on an opposite side of the second element array from the supply port array, wherein the through-hole is formed between the supply ports of the second supply port array.

19. The liquid ejection head as claimed in claim 17, further comprising a fluid path wall formed on a position of the substrate, which corresponds to a position in which the through-hole is formed.

* * * * *